US009808089B2

(12) United States Patent
Lougee

(10) Patent No.: US 9,808,089 B2
(45) Date of Patent: Nov. 7, 2017

(54) COLLAPSIBLE CHAIR WITH COLLAPSIBLE BACK SUPPORT

(71) Applicant: Strongback, LLC, Worcester, MA (US)

(72) Inventor: Laurence Lougee, San Francisco, CA (US)

(73) Assignee: Strongback, LLC, Worcester, MA (US)

( * ) Notice: Subject to any disclaimer, the term of this patent is extended or adjusted under 35 U.S.C. 154(b) by 0 days.

(21) Appl. No.: 15/449,925

(22) Filed: Mar. 4, 2017

(65) Prior Publication Data

US 2017/0172305 A1 Jun. 22, 2017

Related U.S. Application Data

(60) Division of application No. 13/962,242, filed on Aug. 8, 2013, now Pat. No. 9,622,582, which is a division of application No. 12/833,371, filed on Jul. 9, 2010, now Pat. No. 8,511,747, and a continuation-in-part of application No. 12/459,961, filed on Jul. 9, 2009, now Pat. No. 8,100,469.

(60) Provisional application No. 61/313,165, filed on Mar. 12, 2010.

(51) Int. Cl.

| | |
|---|---|
| *A47C 4/28* | (2006.01) |
| *A47C 7/46* | (2006.01) |
| *A47C 4/44* | (2006.01) |

(52) U.S. Cl.

CPC ..... *A47C 4/286* (2013.01); *A47C 4/44* (2013.01); *A47C 7/46* (2013.01)

(58) Field of Classification Search

CPC ..... A47C 4/28; A47C 4/283; A47C 4/286; A47C 4/44; A47C 7/46

USPC ..... 297/16.2, 284.4, 452.3, 452.31, 59, 45

See application file for complete search history.

(56) References Cited

U.S. PATENT DOCUMENTS

| | | | | |
|---|---|---|---|---|
| 588,159 | A * | 8/1897 | Matthews | A47C 4/283 297/45 |
| 820,864 | A * | 5/1906 | Hanger | A47C 1/032 297/317 |
| 5,058,949 | A * | 10/1991 | Von Hoffman | A47C 4/286 297/378.12 |
| 6,186,594 | B1 * | 2/2001 | Valiquette | A47C 7/46 297/284.1 |
| 8,567,860 | B2 * | 10/2013 | Jue | A47C 4/44 297/129 |

* cited by examiner

*Primary Examiner* — Milton Nelson, Jr.
(74) *Attorney, Agent, or Firm* — Brian M. Dingman; Dingman IP Law, PC

(57) ABSTRACT

A collapsible chair includes a collapsible seat having a front portion and an opposing rear portion and a collapsible back. The collapsible back includes a first back support member and a second back support member. Each of the first back support member and the second back support member includes an arcuate portion extending toward the front portion of the collapsible seat. A back membrane is coupled to the back support members and spans a distance between the back support members.

19 Claims, 19 Drawing Sheets

COLLAPSIBLE CHAIR WITH COLLAPSIBLE BACK SUPPORT

CROSS REFERENCE TO RELATED APPLICATIONS

This application is a divisional of U.S. application Ser. No. 13/962,242, filed on Aug. 8, 2013, now issued as U.S. Pat. No. 9,622,582, which itself is a divisional of U.S. application Ser. No. 12/833,371, filed on Jul. 9, 2010, now issued as U.S. Pat. No. 8,511,747, which itself is a continuation-in-part of U.S. application Ser. No. 12/459,961, filed Jul. 9, 2009, now issued as U.S. Pat. No. 8,100,469, and claimed priority to U.S. Provisional Application No. 61/313,165, filed on Mar. 12, 2010. The disclosures of each of the priority applications are incorporated herein by reference in their entireties.

BACKGROUND

The embodiments described herein relate generally to collapsible furniture and, more particularly, to collapsible chairs having a back support. Collapsible chairs are well known around the world as convenient options for seating at locations where seating is otherwise unavailable. They are easily stored, transported, and set up for a variety of indoor and outdoor uses including camping, fishing, painting, sporting events, concerts, and parties, for example. A user may spend a considerable period of time sitting in a collapsible chair during any of these activities. However, conventional collapsible chairs do not provide sufficient back support to maintain a user's spine properly aligned and positioned when the user sits in the chair for a lengthy period of time. When seated in conventional chairs, a person's lower back bends to conform to the sagging curve of the membrane material, a direction that is the reverse of the natural curve of the lower back, thus placing tremendous stress on the intervertebral disks of the spine. This stress results in an often uncomfortable, sometimes painful, and always unhealthy, round curve of the lower back, sometimes called "C-sitting" that can have long lasting effects on a person's quality of life.

FIG. 19 shows a profile 810 of a typical sling style chair with a sling seat 824 like a hammock. Seat 824 slopes or tilts backwards at the front of the seat 830 and slopes frontwards at the rear of the seat 832. This frontward tilt at the rear of the seat 832 forces a seated person's hips to tilt backwards thus forcing the lumbar region of the spine to curve or slump in the wrong direction into a C-sitting position, with the lumbar region following the concave curve in the rear area of the seat 832.

BRIEF SUMMARY

In one aspect, a collapsible chair includes a collapsible seat having a front portion and an opposing rear portion, and a collapsible back. The collapsible back includes a first back support member and a second back support member. Each of the first back support member and the second back support member includes an arcuate portion extending toward the front portion of the collapsible seat. A back membrane is coupled to the back support members and spans a distance between the back support members.

In another aspect, a collapsible chair includes a collapsible seat having a front portion, a rear portion, a plurality of spaced apart members, and a seat membrane coupled to the seat support members and spanning a distance between the seat support members. A collapsible back includes a first back support member, a second back support member, and a back membrane coupled to the back support members and spanning a distance between the back support members. Each back support member has a lower portion and an upper portion. The lower portion is coupled to the collapsible seat and has an arcuate shape. The upper portion is angled away from the front portion of the collapsible seat when the collapsible seat is in a deployed position.

In yet another aspect, a collapsible chair is movable between a collapsed configuration and a deployed configuration. The collapsible chair includes a collapsible seat having a front portion and an opposing rear portion, and a seat membrane providing a support surface with the collapsible chair in the deployed configuration. A collapsible back includes a first back support member having a substantially linear upper portion that transitions into an arcuate lower portion extending toward the front portion of the collapsible seat, and a second back support member having a substantially linear upper portion that transitions into an arcuate lower portion extending toward the front portion of the collapsible seat. A back membrane is coupled to the first back support member and the second back support member and spans a distance between the first back support member and the second back support member.

In an additional aspect, a collapsible chair includes a collapsible seat having a front portion and an opposing rear portion, and a collapsible back. The collapsible seat is angled slightly backward to prevent the user from sliding forward and keep them firmly against the back support section.

In an additional aspect, a collapsible chair includes a collapsible seat having a front portion and an opposing rear portion, and a collapsible back. The collapsible back includes a first back support member and a second back support member. Each of the first back support member and the second back support member includes an arcuate portion extending toward the front portion of the collapsible seat. A back membrane is coupled to the back support members and spans a distance between the back support members. The collapsible seat is located far enough below the apex of the arcuate portion of the collapsible back to allow a user to slide their buttocks firmly against the arcuate portion of the collapsible back while keeping their hips and spine in a healthy, neutral, naturally curved position.

In another aspect, a collapsible chair includes a collapsible seat having a front portion and an opposing rear portion, and a collapsible back. The collapsible back includes a first back support member and a second back support member. Each of the first back support member and the second back support member includes an arcuate portion extending toward the front portion of the collapsible seat. A back membrane is coupled to the back support members and spans a distance between the back support members. The back membrane and back support members are sufficiently strong as to retain the arcuate shape formed by the back support members and the back membrane when a user is seated in the chair, thus supporting the natural convex curve of the user's back.

DETAILED DESCRIPTION

The embodiments described herein provide a foldable or collapsible chair that is movable between a collapsed configuration and a deployed configuration. The collapsible chair includes a collapsible seat having a front portion and an opposing rear portion. A first or seat membrane provides a support surface with the collapsible chair in the deployed configuration. The collapsible chair also includes a collapsible back operatively coupled to the collapsible seat. The collapsible back includes a first back support member and a laterally opposing second back support member each having a substantially linear upper portion that transitions into a lower portion forming an arcuate or curved portion extending toward the front portion of the collapsible seat. A second or back membrane is coupled to the first back support member and the second back support member and spans a distance between the first back support member and the second back support member to provide back support for a person seated on the seat. In certain embodiments, the collapsible back provides a curved back support region that closely matches a curve of the lumbar region of the spine of the person seated on the chair. When a person is sitting on the seat with the collapsible chair in the deployed configuration, the back membrane is relatively taut between the back support members, along at least the upper part of the back support members, so that the back support region adopts a contour that forms a curved lumbar support region that supports the person's back.

In some embodiments of the invention, the collapsible seat that is pivotally connected to the collapsible back is constructed in such a way that, when a person is seated upon the seat membrane, they are tilted back and held firmly against the back support section without slipping forward, away from the back support section. Additionally, tilting the seat minimizes the rearward tilting of the hips at the rear of seats that is common in typical sling style collapsible chairs.

In other embodiments, the seat is located typically at least four inches below the apex of the back support section so there is plenty of room for the buttocks to slide backwards, allowing the spine to be held firmly against the back support section, and the hips to remain neutral in relation to the spine so the spine can remain in a healthy curved position that is supported by the back support section of the collapsible chair.

Figure 1:
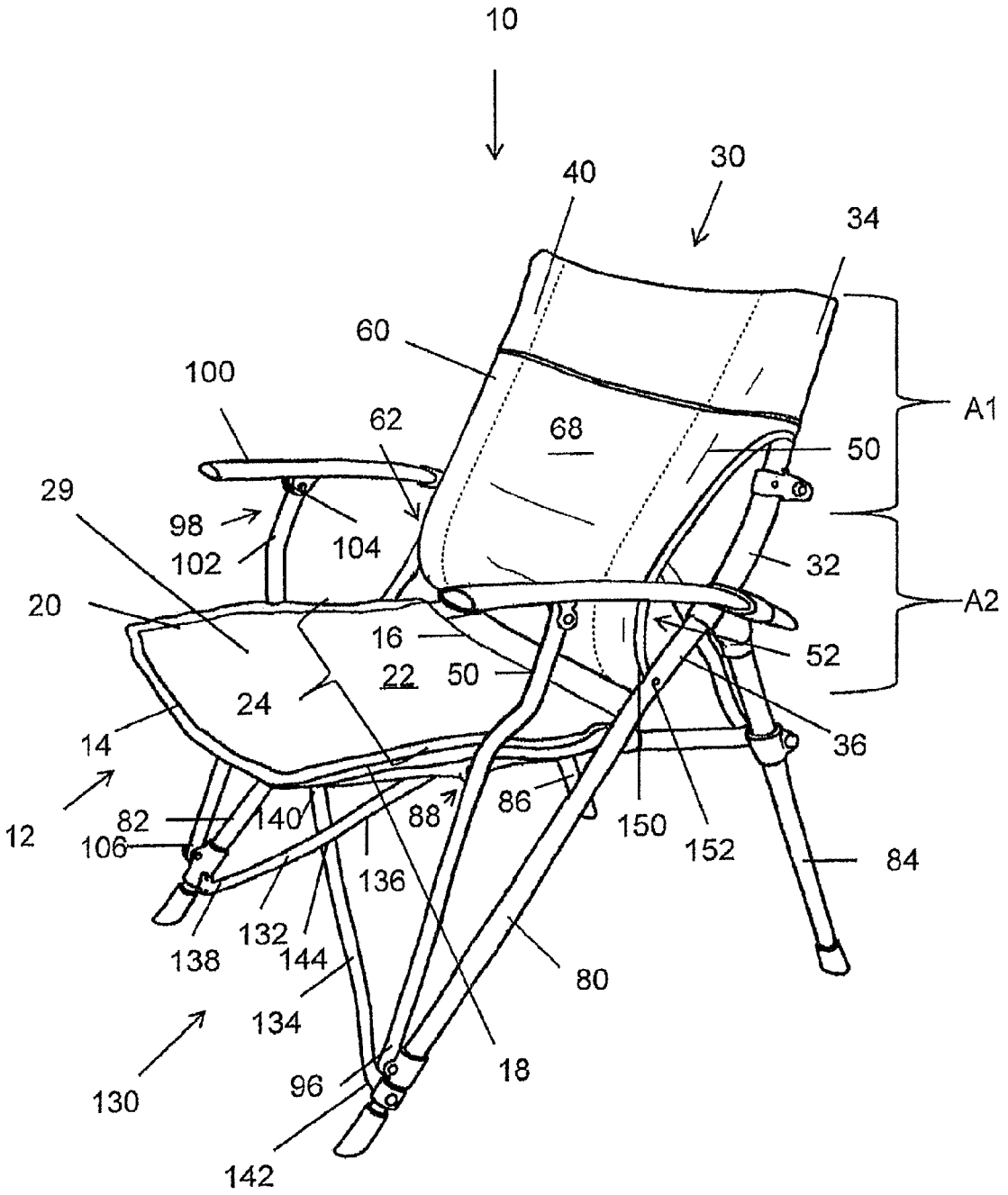
FIG. 1 is a perspective front view of an exemplary collapsible chair in a deployed configuration.
Figure 2:
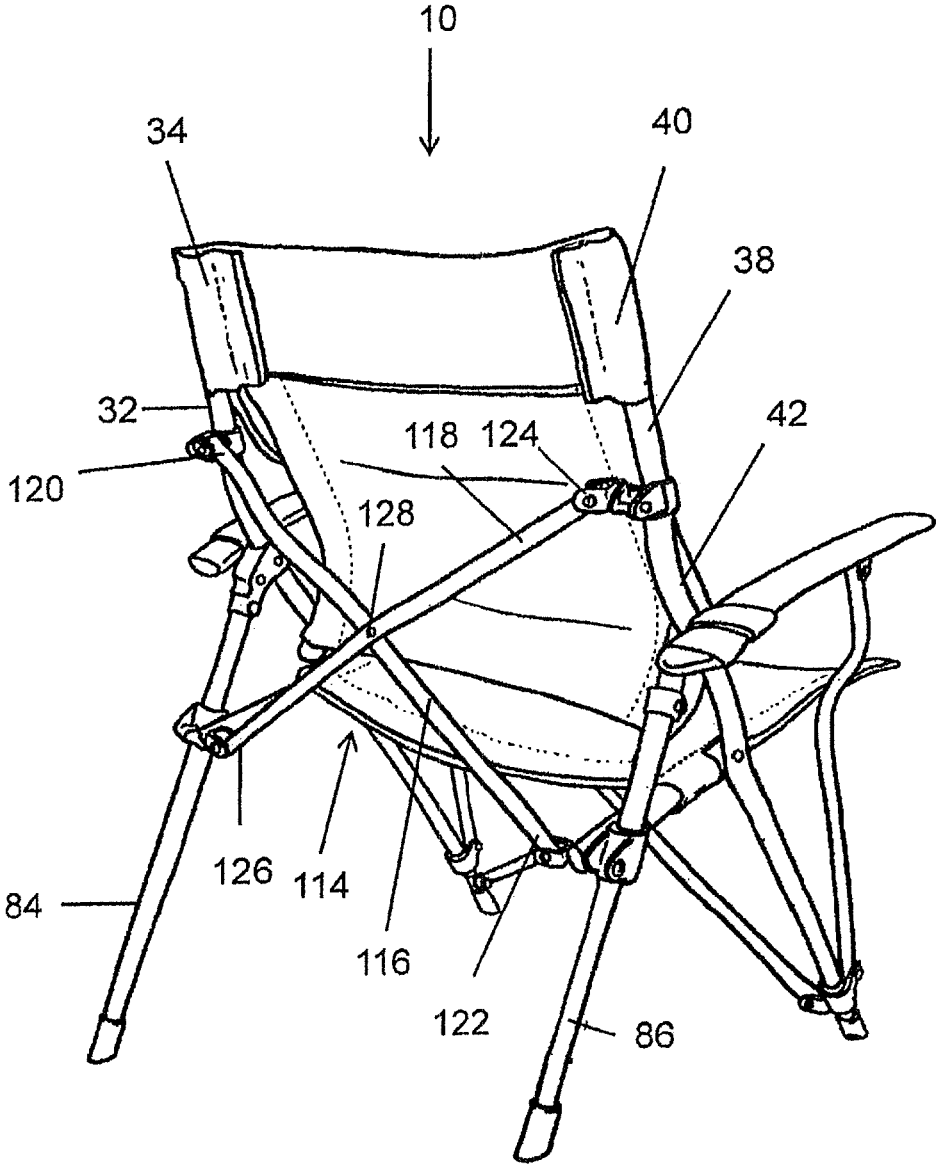
FIG. 2 is a perspective rear view of the collapsible chair shown in FIG. 1.
Figure 3:
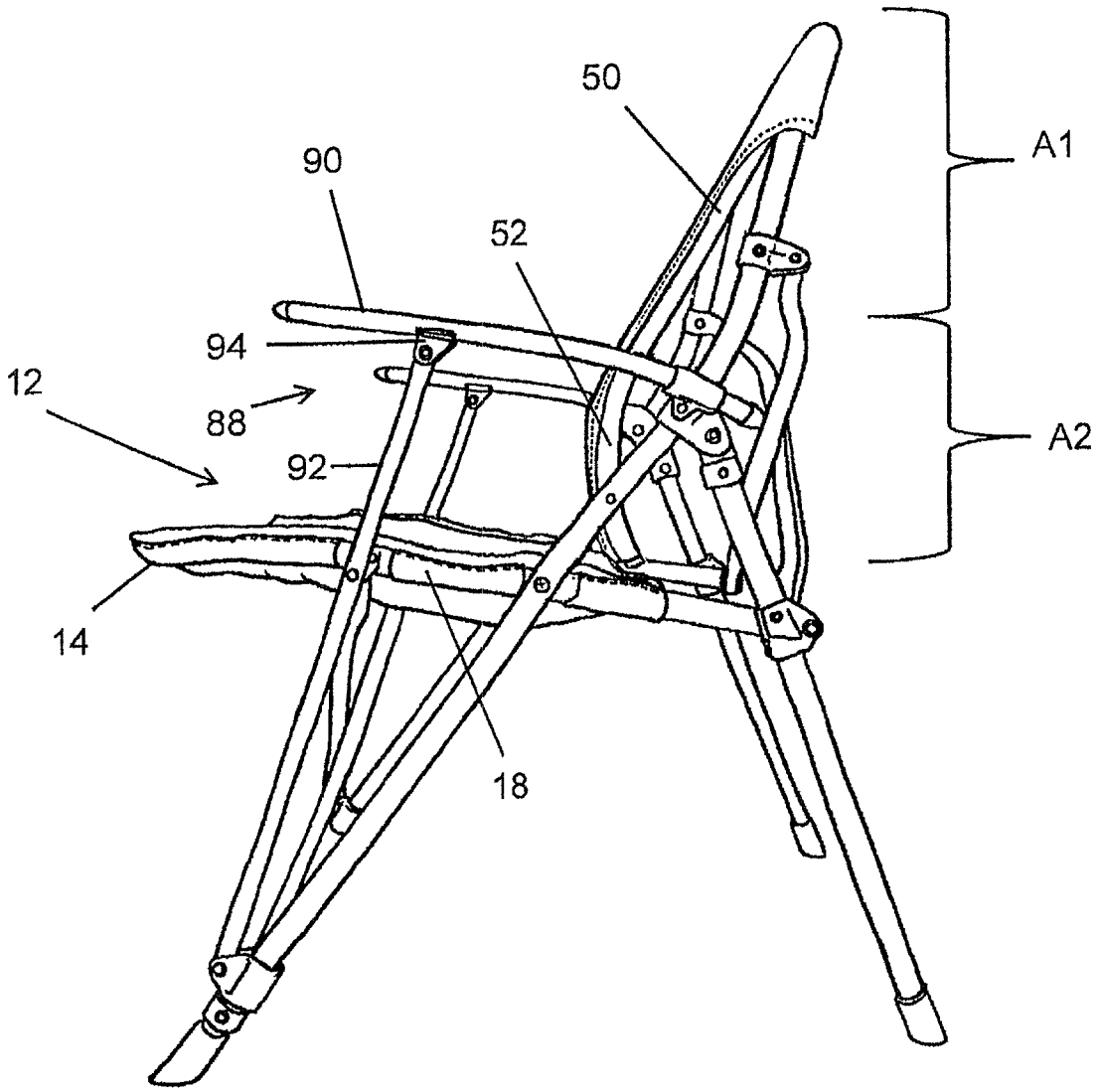
FIG. 3 is a side view of the collapsible chair shown in FIG. 1.
Figure 4:
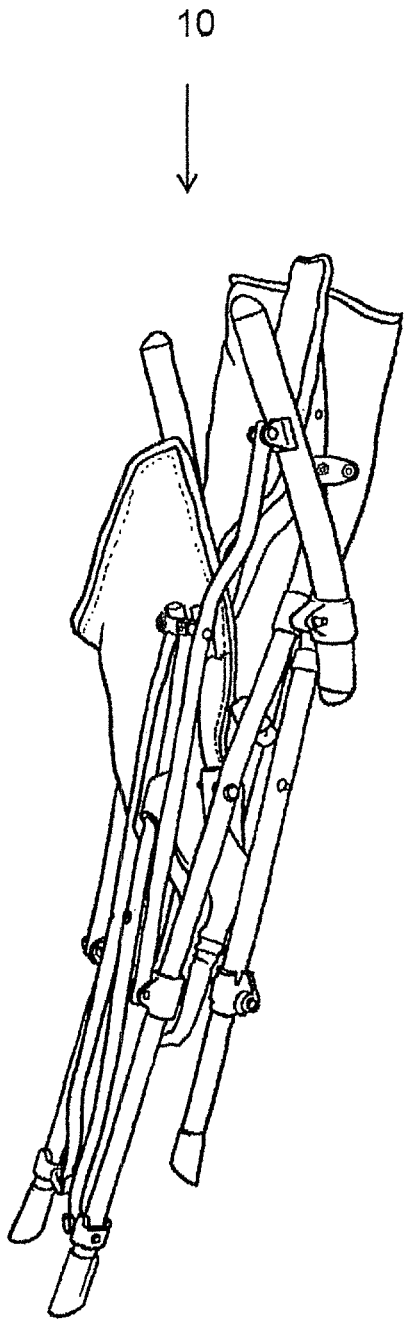
FIG. 4 is a perspective view of the collapsible chair shown in FIG. 1 in a collapsed or folded configuration.

Referring to FIGS. 1-7, in one embodiment a collapsible or foldable chair 10 is movable between a deployed configuration, as shown in FIGS. 1-3, and a collapsed or folded configuration, as shown in FIG. 4. Referring further to FIGS. 1-4, collapsible chair 10 includes a collapsible seat 12 having a front portion 14, a rear portion 16, a first seat support member 18 and a second seat support member 20 spaced apart from first seat support member 18. A seat membrane 22 is coupled to first seat support member 18 and second seat support member 20 and is configured to span a distance 24 defined between first seat support member 18 and second seat support member 20. As shown, for example, in FIG. 1, seat membrane 22 spans a suitable distance 24 with chair 10 in the deployed configuration to allow a user to comfortably sit on seat membrane 22. In certain embodiments, seat membrane 22 is made of a sufficiently durable and suitably flexible, stretch-resistant material, such as a cloth, canvas, or plastic material, to provide a support surface having sufficient strength to support a user.

Figure 5:
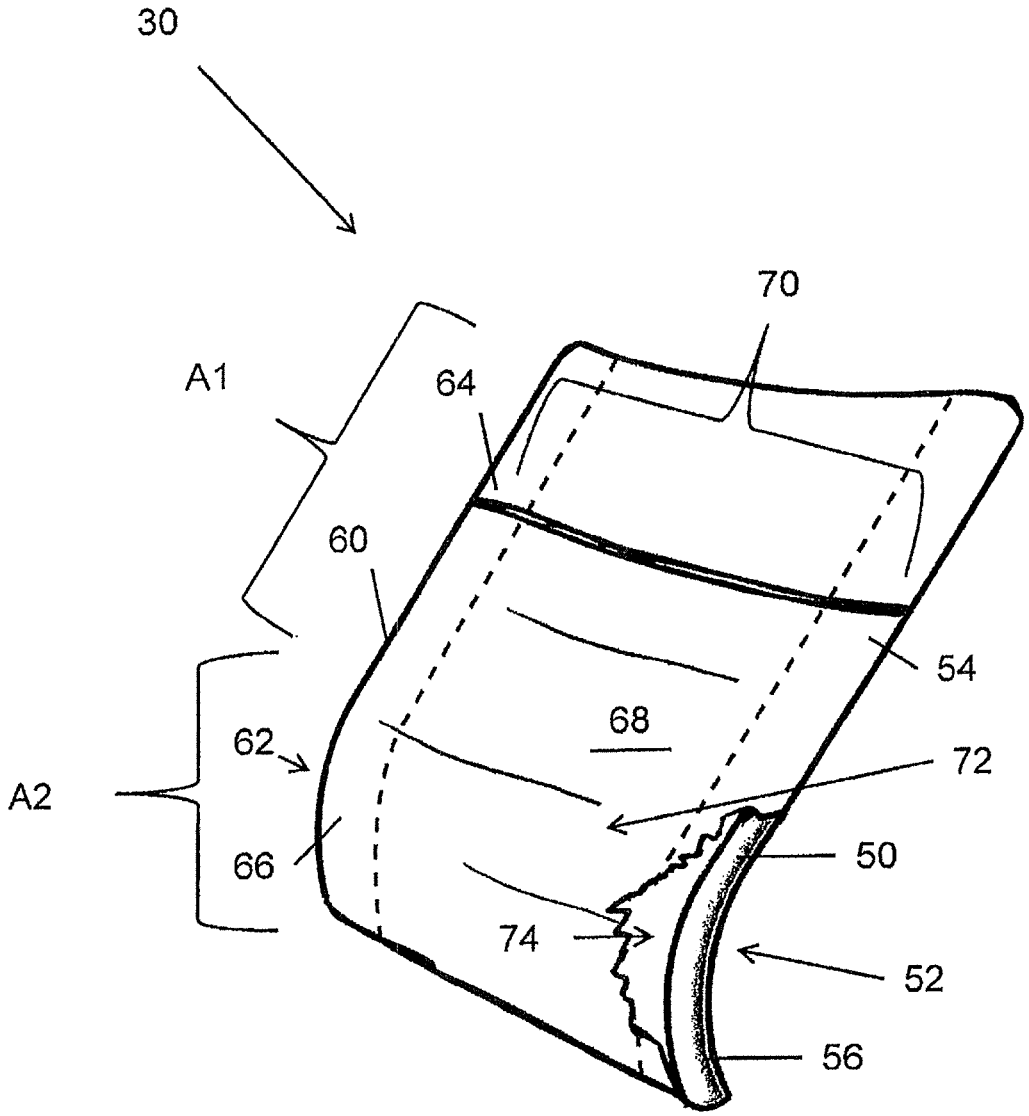
FIG. 5 is a perspective front view of an exemplary collapsible back support in a deployed (open) position.
Figure 6:
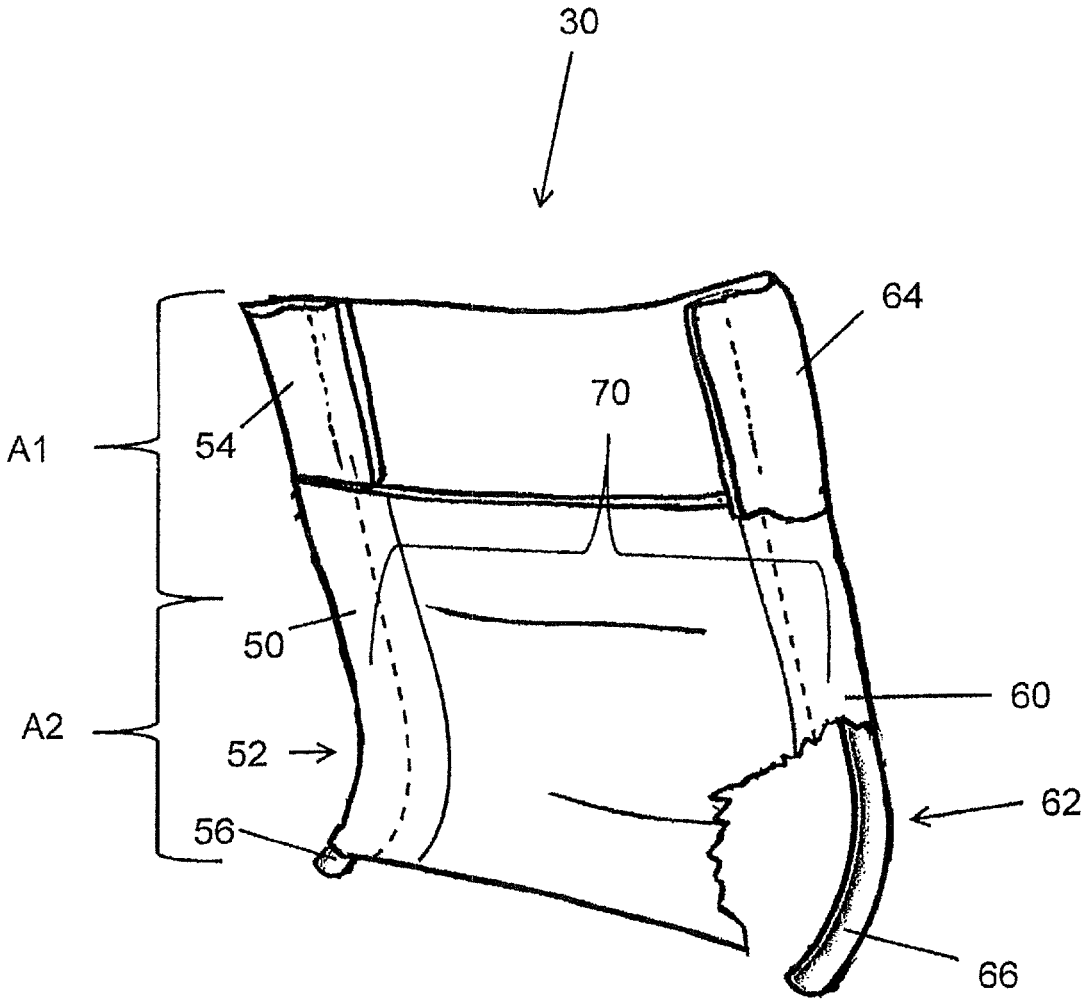
FIG. 6 is a perspective rear view of the collapsible back support shown in FIG. 5.
Figure 7:
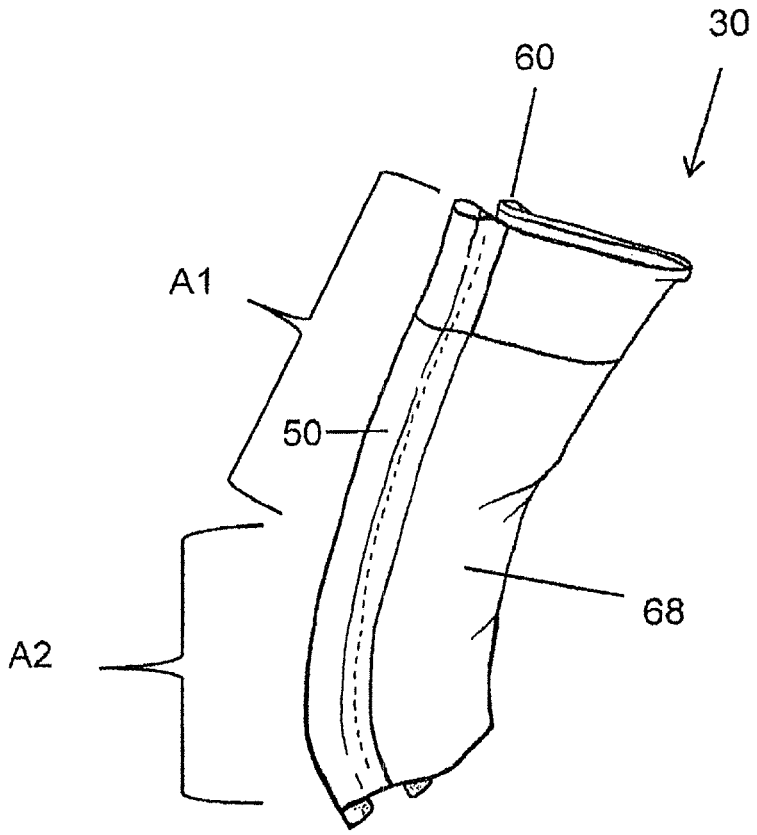
FIG. 7 is a side view of the collapsible back support shown in FIG. 5 in a collapsed or folded configuration.

A collapsible back 30 of collapsible chair 10 is operatively coupled to collapsible seat 12. In one embodiment, collapsible back 30 includes a first back member 32 having a first or upper portion 34 (corresponding to an area $A_1$ of collapsible back 30) that transitions into a second or lower portion 36 (corresponding to an area $A_2$ of collapsible back 30). A second back member 38 is spaced apart from first back member 32 and has a first or upper portion 40 that transitions into a second or lower portion 42. In one embodiment, collapsible back 30 includes a first back support member 50 that is coupled to upper portion 34 of first back member 32 and has an arcuate portion 52 extending toward front portion 14 of collapsible seat 12. Referring further to FIGS. 5-7, first back support member 50 has a substantially linear first or upper portion 54 that transitions into a second or lower portion 56 forming arcuate portion 52. In an alternative embodiment, upper portion 54 and lower portion 56 collectively form arcuate portion 52. Collapsible back 30 also includes a second back support member 60 that is coupled to upper portion 40 of second back member 38 and has an arcuate portion 62 extending toward front portion 14 of collapsible seat 12. Second back support member 60 has a substantially linear first or upper portion 64 (corresponding to an area $A_1$) that transitions into a second or lower portion 66 (corresponding to an area $A_2$) forming arcuate portion 62. In an alternative embodiment, upper portion 64 and lower portion 66 collectively form arcuate portion 62. Arcuate portions 52 and 62 are configured to substantially match or correspond to a curve of a lumbar region of the user's spine (i.e., the user's lower back). In one embodiment, lower portion 56 of first back support member 50 and lower portion 66 of second back support member 60 are coupled to collapsible seat 12 and upper portion 54 of first back support member 50 and upper portion 64 of second back support member 60 are angled away from front portion 14 of collapsible seat 12 when collapsible chair 10 is in the deployed configuration. In a particular embodiment, an angle between collapsible seat 12 and a line extending along upper portion 54 and upper portion 64 is greater than 95 degrees. Or, this line extending along upper portion 54 and upper portion 64 can be angled greater than 10 degrees backward from vertical.

A back membrane 68 is coupled to first back support member 50 and second back support member 60 and is configured to span a distance 70 defined between first back support member 50 and second back support member 60 to form a back support section 72. As shown, for example, in FIG. 5, back membrane 68 spans a suitable distance 70 with chair 10 in the deployed configuration to allow a user to comfortably rest his or her back against back membrane 68. In certain embodiments, back membrane 68 is made of a suitable material such as described above in reference to materials suitable for seat membrane 22. In one embodiment, each of arcuate portion 52 and arcuate portion 62 defines an apex 74 that is positioned greater than about four inches above a lowest portion of seat membrane 22 directly beneath apex 74. When collapsible chair 10 is in the deployed configuration, these four plus inches create a space that allows room for the buttocks to be placed in line with or behind apex 74 such that the lumbar region of the spine is comfortably against the back support section 72, and able to retain a healthy curved position supported by section 72.

As shown in FIGS. 1-4, in one embodiment collapsible chair 10 includes transversely spaced apart front legs 80 and 82 and transversely spaced apart rear legs 84 and 86. A first arm support assembly 88 includes an arm 90 and an arm support 92 pivotally coupled at a first end 94 to arm 90. Arm support 92 is slidably coupled at an opposing second end 96 to front leg 80. Similarly, a second arm support assembly 98 includes an arm 100 and an arm support 102 pivotally coupled at a first end 104 to arm 100. Arm support 102 is slidably coupled at an opposing second end 106 to front leg 82. In one embodiment, a rear support assembly 114 is provided to support the rear portion of the chair frame. As shown in FIG. 2, for example, rear support assembly 114 includes a pair of pivotally coupled crossing support members 116 and 118. A first or upper end portion 120 of crossing support member 116 is pivotally coupled to first back member 32 and an opposing second or lower portion 122 of crossing support member 116 is pivotally coupled to second seat support member 20 and/or rear leg 86. A first or upper end portion 124 of crossing support member 118 is pivotally coupled to second back member 38 and an opposing second or lower portion 126 of crossing support member 118 is pivotally coupled to first seat support member 18 and/or rear leg 84. Crossing support members 116 and 118 are pivotally coupled to one another at a central pivot point 128.

In one embodiment, collapsible chair 10 includes a front support assembly 130 to provide support to a front portion of collapsible chair 10. As shown for example in FIG. 1, front support assembly 130 includes a pair of pivotally coupled crossing support members 132 and 134. A first or upper portion 136 of crossing support member 132 is pivotally coupled to first seat support member 18 and/or arm support 92 and an opposing second or lower portion 138 is pivotally coupled to front leg 82 and/or arm support 102. Similarly, a first or upper portion 140 of crossing support member 134 is pivotally coupled to second seat support member 20 and/or arm support 102 and an opposing second or lower portion 142 is pivotally coupled to front leg 80 and/or arm support 92. Crossing support members 132 and 134 are pivotally coupled to one another at a central pivot point 144.

As shown, for example, in FIGS. 1-3, in one embodiment collapsible back 30 is coupled to and extends upwardly from collapsible seat 12. In this embodiment, collapsible back 30 is coupled to an upward extension of front legs 80 and 82 (which are pivotally coupled to respective first and second seat support members 18 and 20). Back support section 72 includes back membrane 68 that spans transversely spaced apart, forwardly extending, first back support member 50 and second back support member 60, which are coupled proximate respective upper and lower ends to the upward extensions of respective front legs 80 and 82 at a connection point 150 using a suitable fastener such as a bolt, screw, or rivet. As shown in FIG. 3, a bolt 152 passes through first back support member 50 and leg 80 to securely couple first back support member 50 to leg 80. Arcuate portion 52 of first back support member 50 and arcuate portion 62 of second back support member 60 are configured and coupled to collapsible chair 10 to define back support section 72 with back membrane 68 that matches the curve of the lumbar region of the spine of a user seated on collapsible chair 10.

With the user seated in collapsible chair 10, back membrane 68 is kept taut by the weight of the user in collapsible seat 12. More specifically, when the user sits on collapsible seat 12 the weight of the user forces collapsible seat 12 to remain down and open. The force on open collapsible seat 12 places force on rear support assembly 114 and front support assembly 130. As collapsible seat 12 is opened, a vertical distance between lower portion 122 and upper portion 124 and a vertical distance between lower portion 138 and upper portion 140, for example, becomes shorter. Because crossing support members 116 and 118 and crossing support members 132 and 134 have fixed lengths and are operatively coupled to collapsible seat 12 and/or collapsible back 30, distance 24 of collapsible seat 12 and distance 70 of collapsible back 30 increase to compensate for the shortening vertical distance to urge the sides of the chair apart and away from each other. In this embodiment, seat membrane 22 and back membrane 68 are pulled taut as the sides of the chair are forced apart. Advantageously, a tension on seat membrane 22 that is maintained by the weight of a seated user is distributed evenly along first back support member 50 and second back support member 60 to create back support section 72 of uniform taut support. The taut back membrane 68 matches the curve of first and second back support members 50 and 60 and forms a gently curved back support section 72 that matches the natural curve of the human spine to provide positive back support for the seated user that is distributed evenly, thinly, and comfortably along the user's back.

Figure 19:
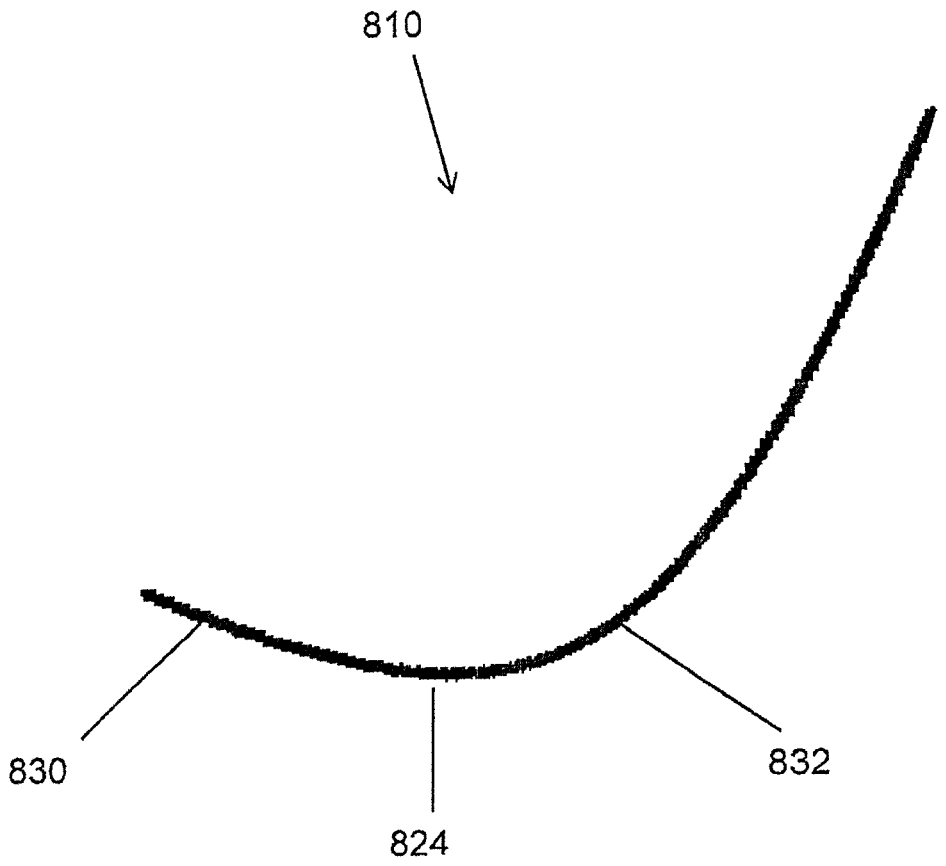
FIG. 19 is a simplified line drawing representing the shape of the membrane that forms the back and the seat of a typical prior art sling chair.

Another aspect of the embodiment represented in FIGS. 1-4 is the rearward tilting of the seat. As mentioned previously a tilted seat holds a seated person firmly against the back support section 72, discourages the buttocks from slipping forward, and helps prevent the hips and lower back from tilting and curving in the wrong direction resulting in C-sitting as occurs in the typical sling chairs represented in FIG. 19. In this embodiment the tilting of the seat is accomplished by the orientation of the parallel seat members 18 and 20 being tilted back towards the back support section 72, with the seat membrane suspended between them.

Figure 8:
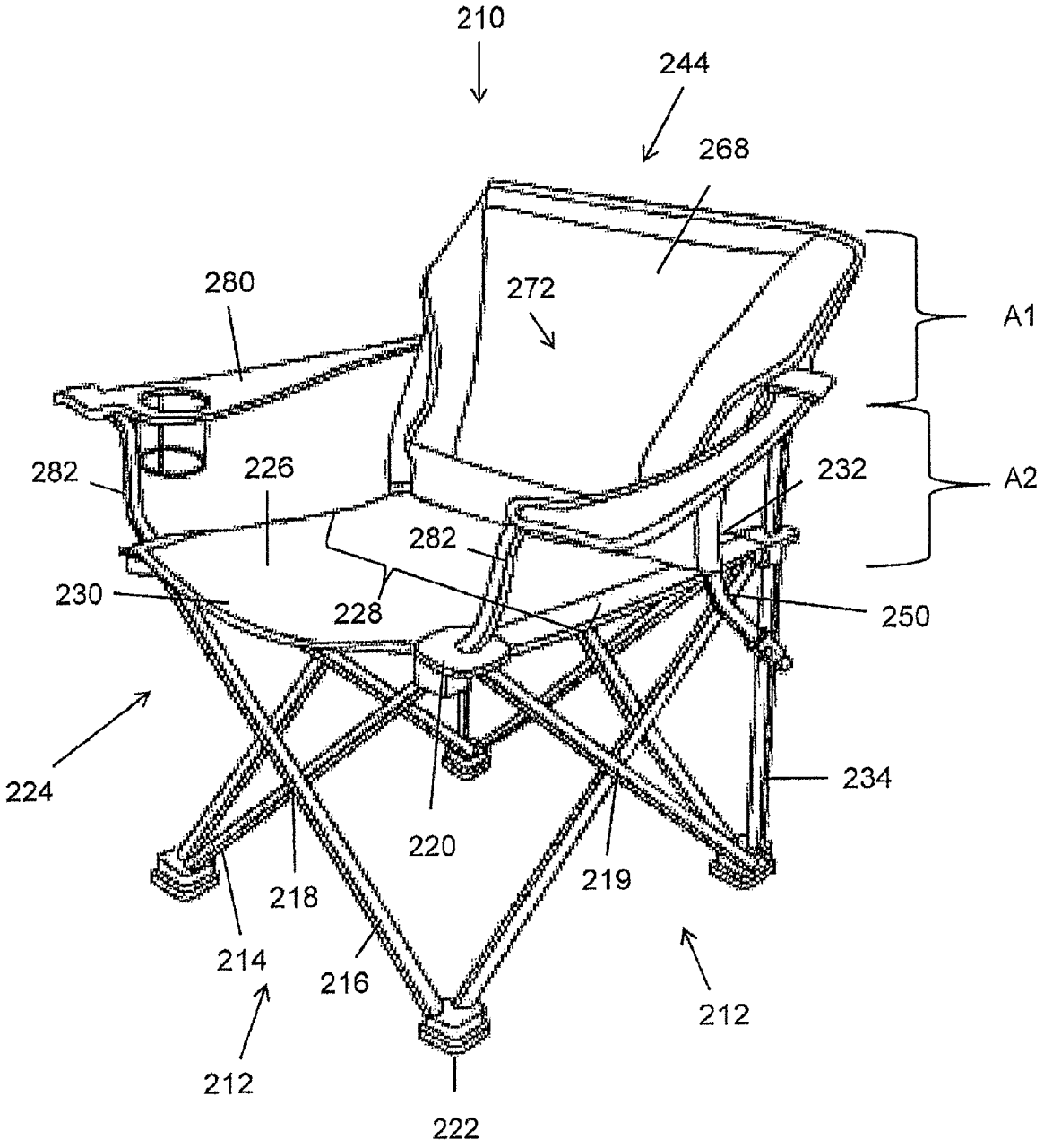
FIG. 8 is a perspective front view of an alternative exemplary collapsible chair in a deployed configuration.
Figure 9:
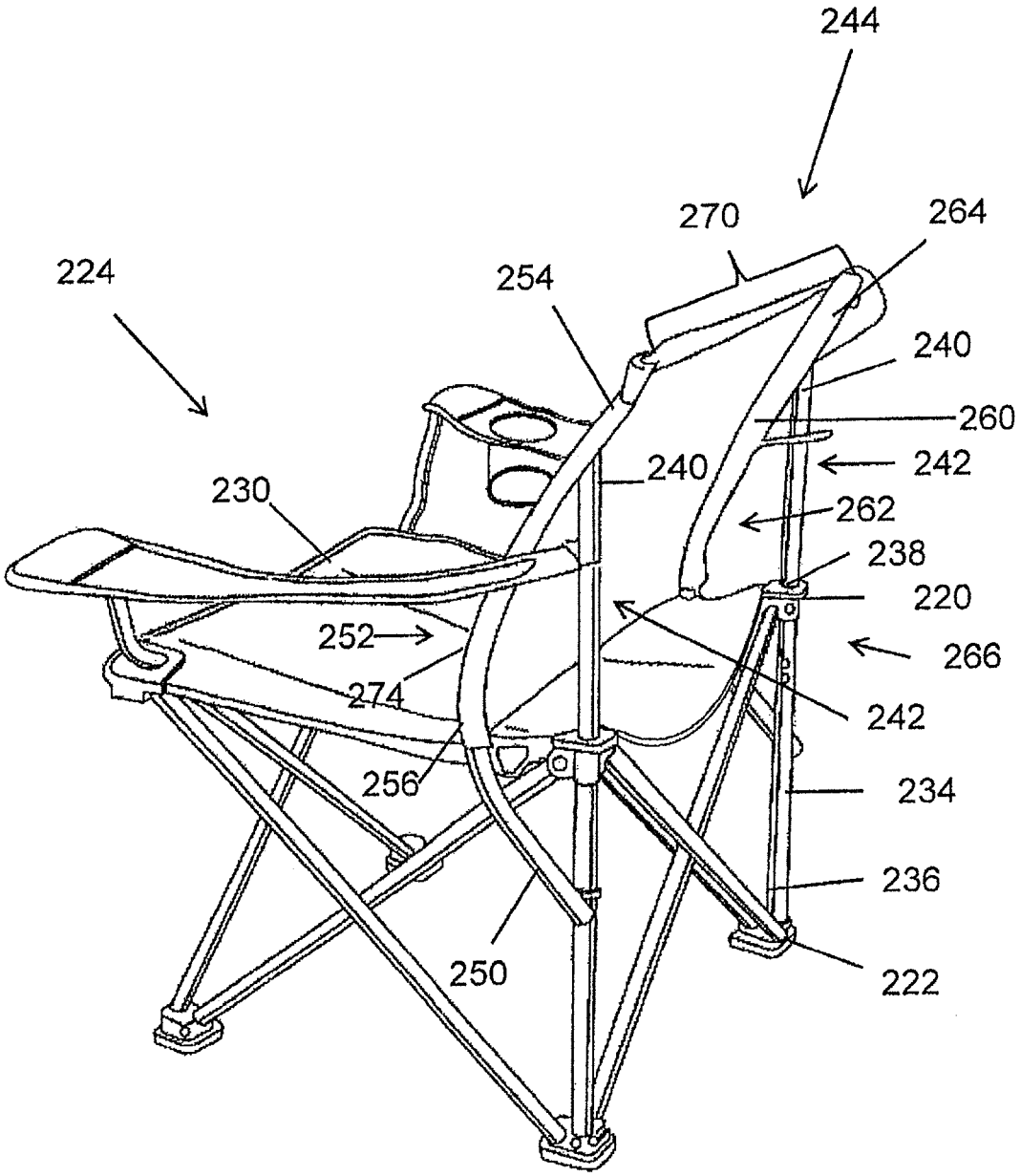
FIG. 9 is a perspective rear view of the collapsible chair shown in FIG. 8.
Figure 10:
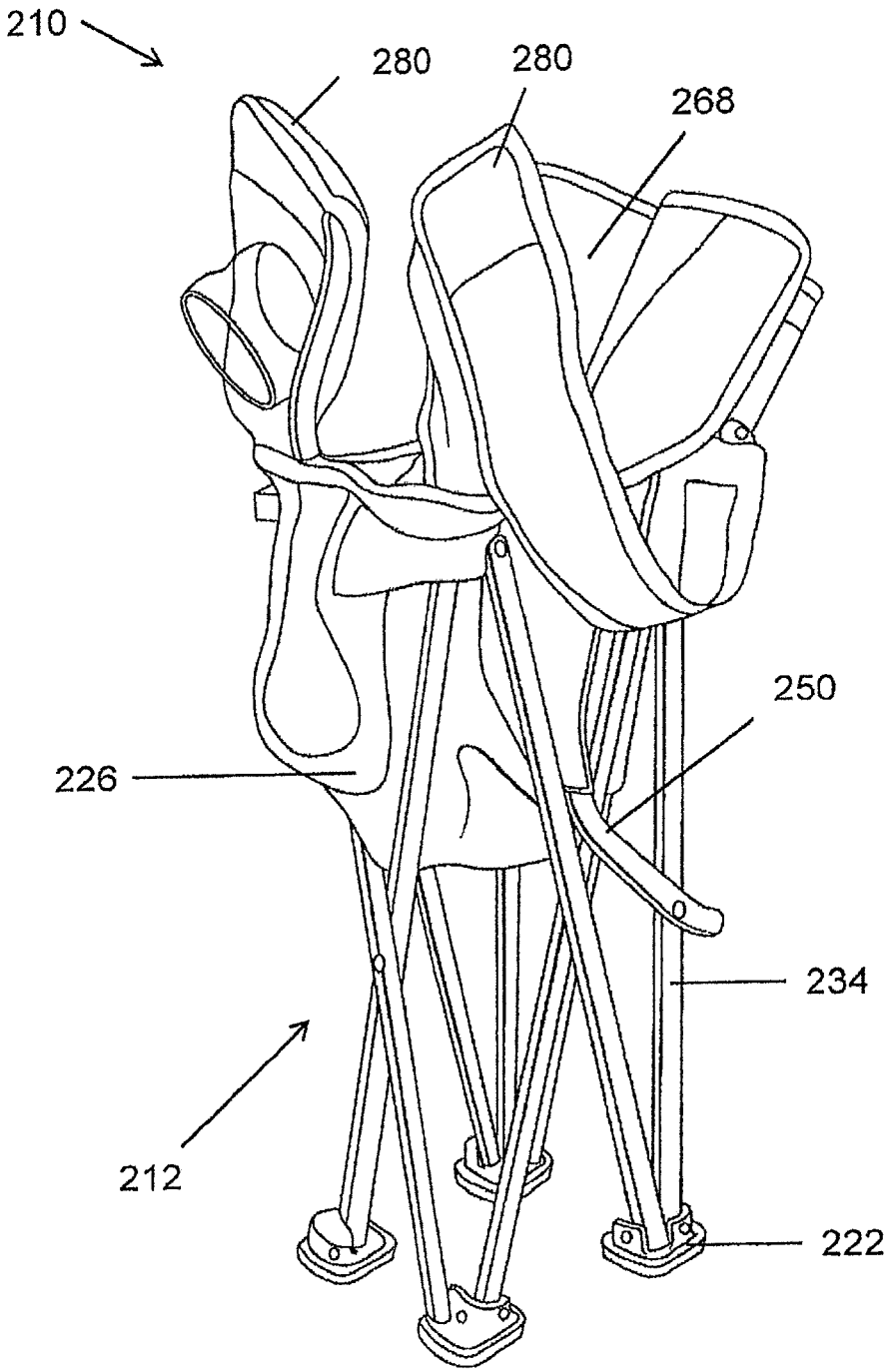
FIG. 10 is a perspective front view of the collapsible chair shown in FIG. 8 in a collapsed or folded configuration.

Referring now to FIGS. 8-10, in one embodiment a collapsible or foldable chair 210 is movable between a deployed configuration, as shown in FIGS. 8 and 9, and a collapsed or folded configuration, as shown in FIG. 10. Collapsible chair 210 includes a plurality of scissor units 212. As shown, for example, in FIG. 8, collapsible chair 210 includes four scissor units 212. Each scissor unit 212 includes a first frame member 214 pivotally coupled to a second frame member 216 at a pivot point 218. First frame member 214 is coupled to second frame member 216 using a suitable fastener 219, such as a rivet or pin, which facilitates pivotal movement of first frame member 214 and second frame member 216. Adjacent scissor units 212 are coupled together at a first or upper connector 220 and a second or lower connector 222. It should be apparent to those skilled in the art that, in alternative embodiments, collapsible chair 210 may include any suitable number of scissor units 212.

In the embodiment shown in FIGS. 8-10, each first frame member 214 and each second frame member 216 is pivotally coupled at a first end portion to a respective upper connector 220 and at an opposing second end portion to a respective lower connector 222. Further, a collapsible seat 224 is coupled to and/or supported by upper connectors 220 such that, with collapsible chair 210 in the deployed configuration, collapsible seat 224 is supported by scissor units 212 to provide a suitable sitting or support area for a user. Collapsible seat 224 includes a seat membrane 226 that is coupled to upper connectors 220 and is configured to span a distance 228 defined between laterally opposing upper connectors 220 at a front portion 230 and a rear portion 232 of collapsible chair 210. In certain embodiments, seat membrane 226 is made of a sufficiently durable and suitably flexible, stretch-resistant material, such as a cloth, canvas, or plastic material, having sufficient strength to support a user.

As shown in FIGS. 8-10, collapsible chair 210 also includes two upright poles 234. Referring further to FIG. 9, each upright pole 234 is coupled to a respective lower connector 222 at a first or lower portion 236 and extends through a bore 238 defined through respective upper connector 220 such that a second or upper portion 240 opposing lower portion 236 forms a back member 242 configured to at least partially support a collapsible back 244 of collapsible chair 210. Collapsible back 244 is operatively coupled to collapsible seat 224. In one embodiment, collapsible back 244 includes a first back support member 250 that is coupled to upper portion 240 of first back member 242 and has an arcuate portion 252 extending toward front portion 230 of collapsible seat 224. Referring further to FIG. 9, first back support member 250 has a substantially linear first or upper portion 254 (corresponding to an area $A_1$ of collapsible back 244) that transitions into a second or lower portion 256 (corresponding to an area $A_2$ of collapsible back 244) forming arcuate portion 252. In an alternative embodiment, upper portion 254 and lower portion 256 collectively form arcuate portion 252. Collapsible back 244 also includes a second back support member 260 that is coupled to upper portion 240 of a second back member 242 and has an arcuate portion 262 extending toward front portion 230 of collapsible seat 224. Second back support member 260 has a substantially linear first or upper portion 264 that transitions into a second or lower portion 266 forming arcuate portion 262. In an alternative embodiment, upper portion 264 and lower portion 266 collectively form arcuate portion 262. Arcuate portions 252 and 262 are configured to substantially match or correspond to a curve of a lumbar region of the user's spine (i.e., the user's lower back). In one embodiment, upper portion 254 of first back support member 250 and upper portion 264 of second back support member 260 are angled away from front portion 230 of collapsible seat 224 when collapsible seat 224 is in the deployed position. In a particular embodiment, an angle between collapsible seat 224 and a line extending along upper portion 254 and upper portion 264 is greater than 95 degrees. Or, a line extending along upper portion 254 and upper portion 264 is angled greater than 10 degrees backward from vertical.

A back membrane 268 is coupled to first back support member 250 and second back support member 260 and is configured to span a distance 270 defined between first back support member 250 and second back support member 260 to form a back support section 272. As shown, for example, in FIG. 8, back membrane 268 spans a suitable distance 270 with collapsible chair 210 in the deployed configuration to allow a user to comfortably rest his or her back against back membrane 268. In certain embodiments, back membrane 268 is made of a suitable material such as described above in reference to materials suitable for seat membrane 226. In one embodiment, each of arcuate portion 252 and arcuate portion 262 defines an apex 274 that is positioned greater than about four inches above a lowest portion of seat membrane 226 directly beneath apex 274, when collapsible chair 210 is in the deployed configuration. When collapsible chair 210 is in the deployed configuration, these four plus inches create a space that allows room for the buttocks to be placed in line with or behind apex 274 such that the lumbar region of the spine is comfortably against the back support section 272, and able to retain a healthy curved position supported by section 272.

As shown in FIGS. 8 and 9, first frame member 214 and second frame member 216 of scissor unit 212 are positioned at a front portion of collapsible chair 210 to support suitable armrests 280 that extend between back members 242 and a respective front member 282 defined by first frame member 214 or second frame member 216. Armrests 280 may be made of a suitable flexible material, such as a suitable fabric material similar to or different from the material of seat membrane 226 and/or back membrane 268.

With the user seated in collapsible chair 210, back membrane 268 is kept taut by the weight of the user in the collapsible seat 224. More specifically, when the user sits on collapsible seat 224 the weight of the user forces collapsible seat 224 to remain down and open. In this embodiment, seat membrane 226 and back membrane 268 are pulled taut as the sides of the chair are forced apart. Advantageously, a tension on seat membrane 226 that is maintained by the weight of a seated user is distributed evenly along first back support member 250 and second back support member 260 to create back support section 272 of uniform taut support. To prevent the back support members 250 and 260 from twisting or rotating towards one another when a seated person's weight rests against the back support membrane 268, the lower section of back support members 250 and 260, below the $A_2$ of collapsible back 244, rest against frame members 214 and/or 216 respectively; frame members 214 and 216 act as braces that prevent the back support members 250 and 260 from turning or twisting inward, thus allowing them to retain the strength and rigidity necessary to maintain their arcuate shape. The taut back membrane 268 matches the braced curve of first and second back support members 250 and 260 and forms a gently curved back support section 272 that matches the natural curve of the human spine to provide positive back support for the seated user that is distributed evenly, firmly, and comfortably along the user's back.

In one embodiment collapsible chair 210 has a seat 224 that is tilted backwards from horizontal by suspending the seat membrane 226 at different tensions between the front upper connectors and the rear upper connectors 220 of scissor units 212. More specifically, the seat membrane 226 is more slack at the rear of the seat 232 than it is at the front of the seat 230. In FIG. 9 it can be seen how the seat membrane 226 sags more at the rear of the chair than the front of the chair thus causing a net backward tilting effect of the seat. The tilted seat holds a seated person firmly against the back support section 272, discourages the buttocks from slipping forward away form the back support section 272, and helps prevent the hips and lower back from tilting and curving in the wrong direction resulting in C-sitting as occurs in the typical sling chairs represented in FIG. 19.

Figure 11:
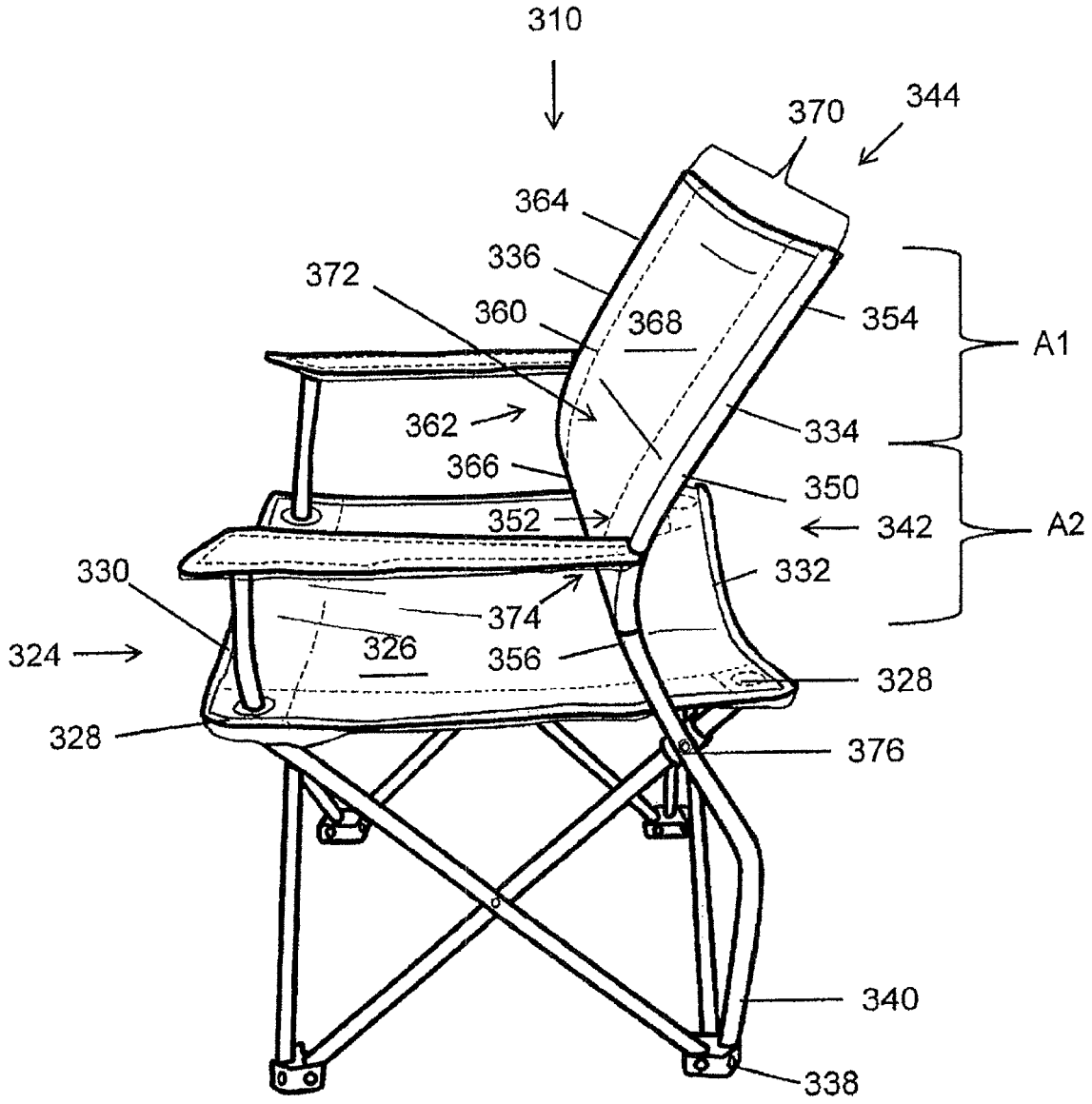
FIG. 11 is a perspective side view of an alternative exemplary collapsible chair in a deployed configuration.

In an alternative embodiment shown in FIG. 11, a collapsible chair 310 includes a collapsible seat 324 having a seat membrane 326 that is coupled to upper connectors 328 at a front portion 330 and a rear portion 332 of collapsible seat 324. In certain embodiments, seat membrane 326 is made of a sufficiently durable and suitably flexible, stretch-resistant material, such as a cloth, canvas, or plastic material, having sufficient strength to support a user.

Collapsible chair 310 includes a first back member 334 and a second back member 336. Each back member 334 and 336 is coupled to a respective lower connector 338 at a first or lower portion 340 and extends upwardly such that a second or upper portion 342 opposing lower portion 340 forms a collapsible back 344 of collapsible chair 310. First back member 334 forms a first back support member 350 at upper portion 342 having an arcuate portion 352 extending toward front portion 330 of collapsible seat 324. First back support member 350 has a substantially linear first or upper portion 354 (corresponding to an area $A_1$ of collapsible back 344) that transitions into a second or lower portion 356 (corresponding to an area $A_2$ of collapsible back 344) forming arcuate portion 352. In an alternative embodiment, upper portion 354 and lower portion 356 collectively form arcuate portion 352. Collapsible back 344 also includes a second back support member 360 that is coupled to upper portion 342 of second back member 336 and has an arcuate portion 362 extending toward front portion 330 of collapsible seat 324. Second back support member 360 has a substantially linear first or upper portion 364 that transitions into a second or lower portion 366 forming arcuate portion 362. In an alternative embodiment, upper portion 364 and lower portion 366 collectively form arcuate portion 362. Arcuate portions 352 and 362 are configured to substantially match or correspond to a curve of a lumbar region of the user's spine (i.e., the user's lower back). In one embodiment, upper portion 354 of first back support member 350 and upper portion 364 of second back support member 360 are angled away from front portion 330 of collapsible seat 324 and extend backwards from seat 324, as shown in FIG. 11, when collapsible seat 324 is in the deployed position. In a particular embodiment, an angle between collapsible seat 324 and a line extending along upper portion 354 and upper portion 364 is greater than 95 degrees. Or, a line extending along upper portion 354 and upper portion 364 is angled greater than 10 degrees backward from vertical.

A back membrane 368 is coupled to first back member 334 and second back member 336 and is configured to span a distance 370 defined between first back support member 350 and second back support member 360 to form a back support section 372. As shown in FIG. 11, back membrane 368 spans a suitable distance 370 with collapsible chair 310 in the deployed configuration to allow a user to comfortably rest his or her back against back membrane 368. In certain embodiments, back membrane 368 is made of a suitable material such as described above in reference to materials suitable for seat membrane 326. In one embodiment, each of arcuate portion 352 and arcuate portion 362 defines an apex 374 that is positioned greater than about four inches above a lowest portion of seat membrane 326 directly beneath it, when collapsible chair 310 is in the deployed configuration. When collapsible chair 310 is in the deployed configuration, these four plus inches create a space that allows room for the buttocks to be placed in line with or behind apex 374 such that the lumbar region of the spine is comfortably against the back support section 372, and able to retain a healthy curved position supported by section 272.

Collapsible chair 310, as shown in FIG. 11, includes back support members 350 and 360 that extend downward to form rear legs of collapsible chair 310 rather than requiring separate points of attachment to rear legs as in the embodiment shown in FIGS. 8-10. Back support members 350 and 360 are slidably coupled to the upper portions of respective scissor units. When this chair is collapsed the sliders 376 slide down the scissor units allowing the chair to collapse. When the chair is in the open deployed position the sliders 376 are braced against the scissor units and prevent the back support members 350 and 360 from turning or twisting inwards thus maintaining the curved shape of the back support section 372.

When in a deployed position, as described in the embodiment represented in FIGS. 8-10, the back membrane 368 of the embodiment of FIG. 11 is pulled taut between first and second back support members 350 and 360 and forms a gently curved back support section 372 that matches the natural curve of the human spine to provide positive back support for the seated user that is distributed evenly, firmly, and comfortably along the user's back.

In one embodiment collapsible chair 310 has a seat 324 that is tilted backwards from horizontal by suspending the seat membrane 326 at different tensions between the front upper connectors and the rear upper connectors 328. More specifically, the seat membrane 326 is more slack at the rear of the seat 332 than it is at the front of the seat 330. The tilted seat holds a seated person firmly against the back support section 372, discourages the buttocks from slipping forward away from the back support section 372, and helps prevent the hips and lower back from tilting and curving in the wrong direction resulting in C-sitting as occurs in the typical sling chairs represented in FIG. 19.

FIGS. 12-15 show an alternative embodiment of a collapsible chair 410, sometimes referred to as a stadium seat. Collapsible chair 410 includes a collapsible seat 412 having a front portion 414, a rear portion 416, a first seat support member 418 and a second seat support member 420 spaced apart from first seat support member 418. A seat membrane 422 is coupled to first seat support member 418 and second seat support member 420 and is configured to span a distance 424 defined at least partially between first seat support member 418 and second seat support member 420. In certain embodiments, seat membrane 422 is made of a sufficiently durable and suitably flexible, stretch-resistant material, such as a cloth, canvas, or plastic material, having sufficient strength to support a user.

Figure 12:
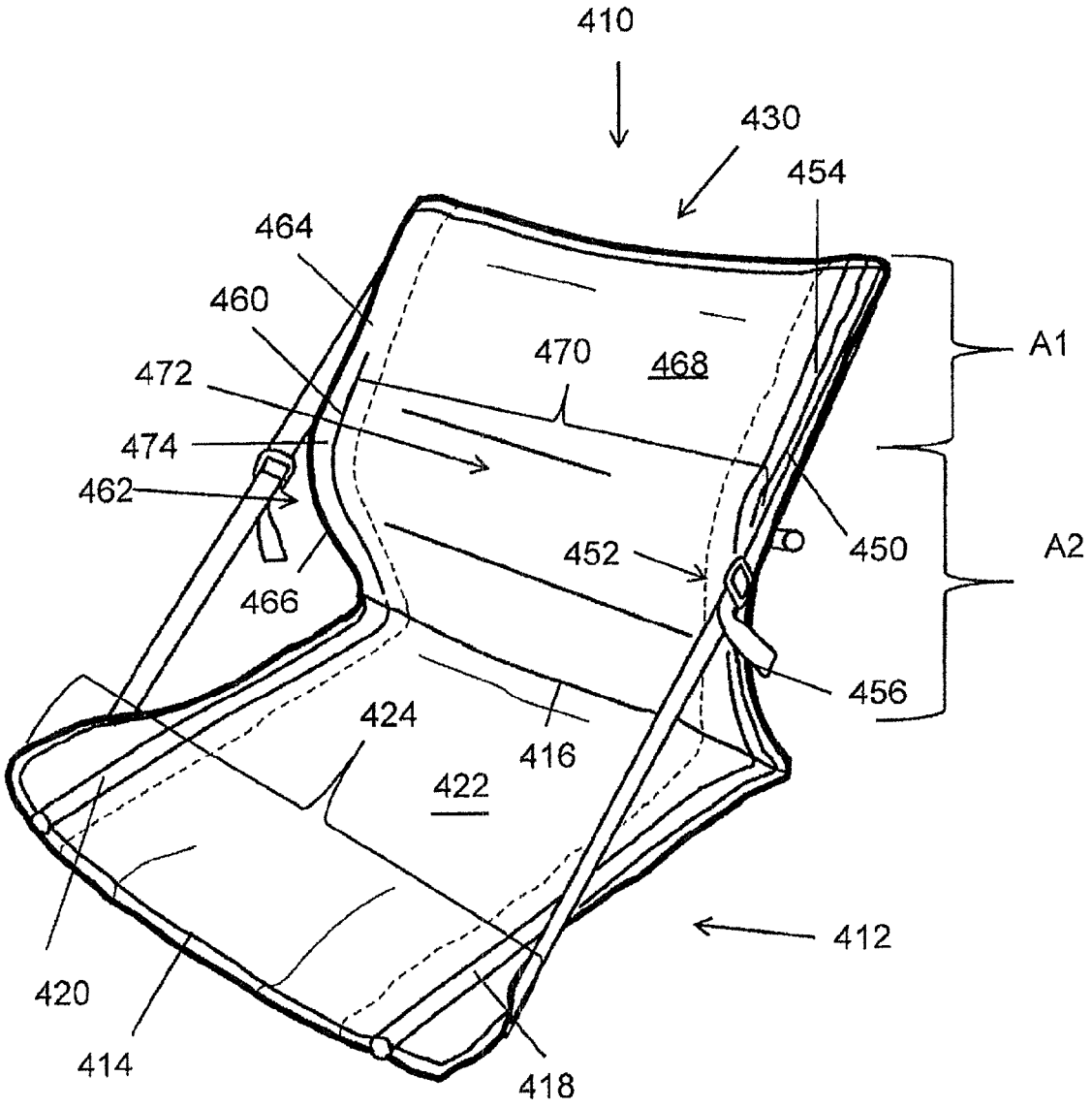
FIG. 12 is a perspective front view of an exemplary collapsible chair without legs (sometimes referred to as stadium seats)
Figure 13:
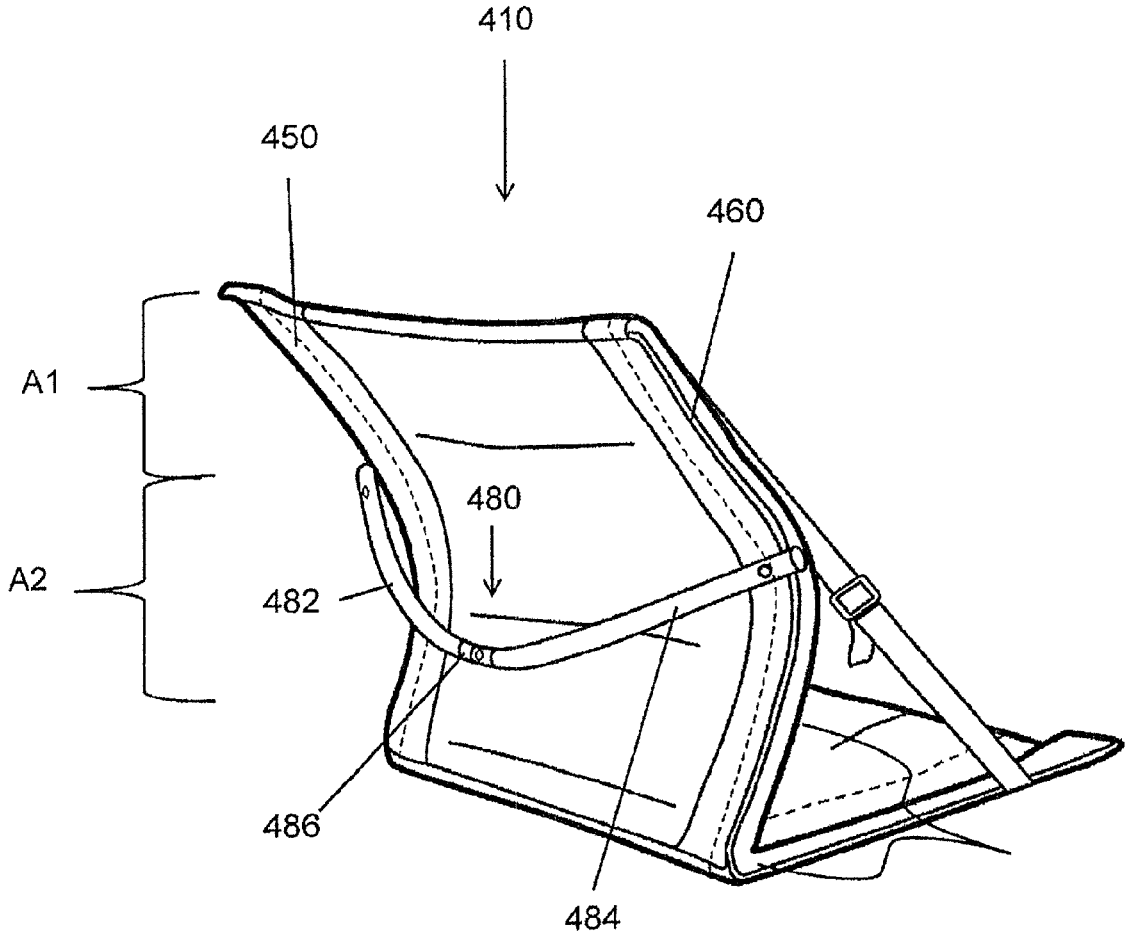
FIG. 13 is a perspective rear view of the collapsible chair shown in FIG. 12.

A collapsible back 430 of collapsible chair 410 is operatively coupled to collapsible seat 412. In one embodiment, collapsible back 430 includes a first back support member 450 having an arcuate portion 452 extending toward front portion 414 of collapsible seat 412. As shown in FIGS. 12 and 13, first back support member 450 has a substantially linear first or upper portion 454 (corresponding to an area $A_1$ of collapsible back 430) that transitions into a second or lower portion 456 (corresponding to an area $A_2$ of collapsible back 430) forming arcuate portion 452. In an alternative embodiment, upper portion 454 and lower portion 456 collectively form arcuate portion 452. Collapsible back 430 also includes a second back support member 460 having an arcuate portion 462 extending toward front portion 414 of collapsible seat 412. Second back support member 460 has a substantially linear first or upper portion 464 that transitions into a second or lower portion 466 forming arcuate portion 462. In an alternative embodiment, upper portion 464 and lower portion 466 collectively form arcuate portion 462. Arcuate portions 452 and 462 are configured to substantially match or correspond to a curve of a lumbar region of the user's spine (i.e., the user's lower back). In one embodiment, upper portion 454 of first back support member 450 and upper portion 464 of second back support member 460 are angled away from front portion 414 of collapsible seat 412 and extend backwards from seat 412, as shown in FIGS. 12 and 13, when collapsible seat 412 is in the deployed position. In a particular embodiment, an angle between collapsible seat 412 and a line extending along upper portion 454 and upper portion 464 is greater than 95 degrees. Or, a line extending along upper portion 454 and upper portion 464 is angled greater than 10 degrees backward from vertical.

A back membrane 468 is coupled to first back support member 450 and second back support member 460 and is configured to span a distance 470 defined between first back support member 450 and second back support member 460 to form a back support section 472. As shown, for example, in FIG. 12, back membrane 468 spans a suitable distance 470 with chair 410 in the deployed configuration to allow a user to comfortably rest his or her back against back membrane 468. In certain embodiments, back membrane 468 is made of a suitable material such as described above in reference to materials suitable for seat membrane 422. In one embodiment, each of arcuate portion 452 and arcuate portion 462 defines an apex 474 that is positioned greater than about four inches above a lowest portion of seat membrane 422 directly below it, when collapsible chair 410 is in the deployed configuration. When collapsible chair 410 is in the deployed configuration, these four plus inches create a space that allows room for the buttocks to be placed in line with or behind apex 474 such that the lumbar region of the spine is comfortably against the back support section 472, and able to retain a healthy curved position supported by section 472.

Figure 14:
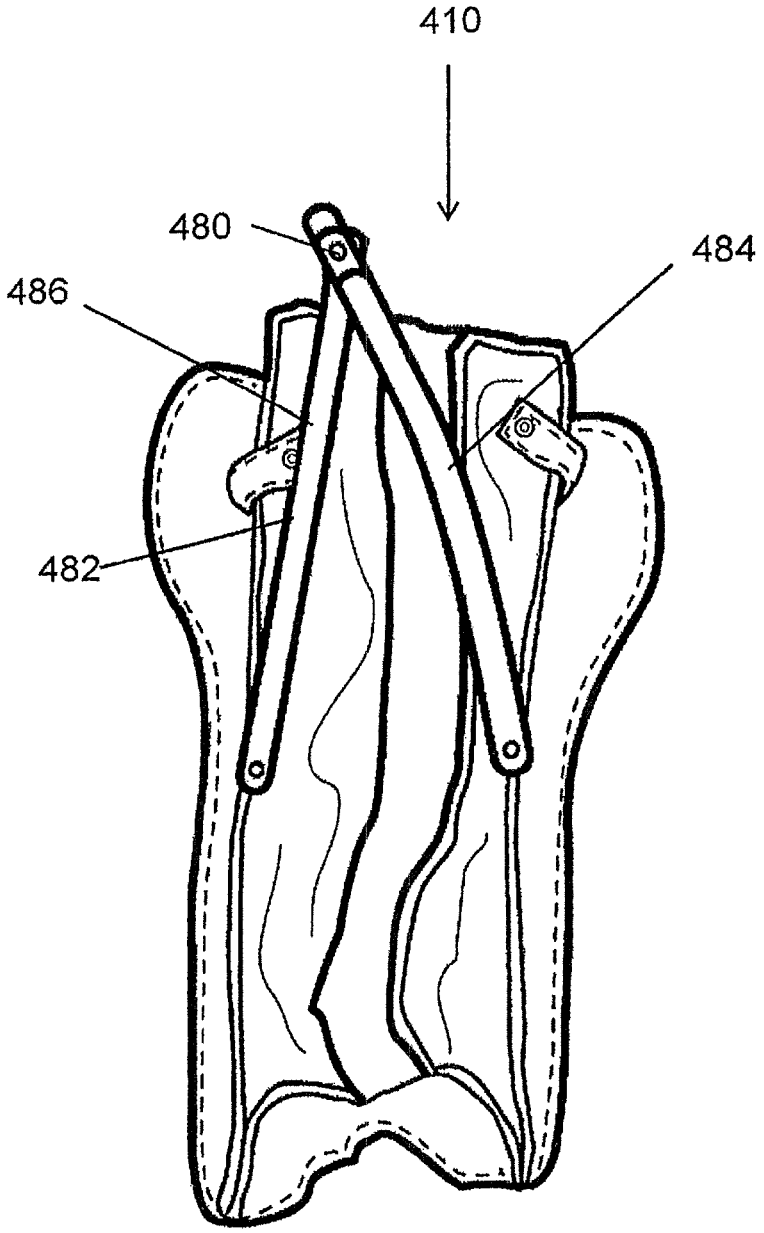
FIG. 14 is a perspective rear view of the collapsible chair shown in FIG. 12, in a partially collapsed or folded configuration.

First back support member 450 and second back support member 460 are pivotally coupled to respective first seat support member 418 and second seat support member 420. Referring to FIGS. 13 and 14, a brace assembly 480 maintains collapsible chair 410 in the deployed configuration. Brace assembly 480 includes a first brace member 482 and a second brace member 484 pivotally coupled at one end to a respective first back support member 450 and second back support member 460, and coupled to each other at a central pivot point 486. To deploy collapsible chair 410, brace assembly 480 is pushed at central pivot point 486 in a first direction, such as towards a support surface on which collapsible chair 410 is positioned, which urges first brace member 482 and second brace member 484 to urge first back support member 450 and second back support member 460 away from each other. In one embodiment, this motion stops when first brace member 482 and second brace member 484 form a straight line, parallel to the ground, and/or back membrane 468 between first back support member 450 and second back support member 460 is stretched taut. The taut back membrane 468 matches the curve of the first and second back support members 450 and 460 and forms a gently curved back support section 472 that matches the natural curve of the human spine to provide positive back support for the seated user that is distributed evenly, firmly, and comfortably along the user's back.

Figure 15:
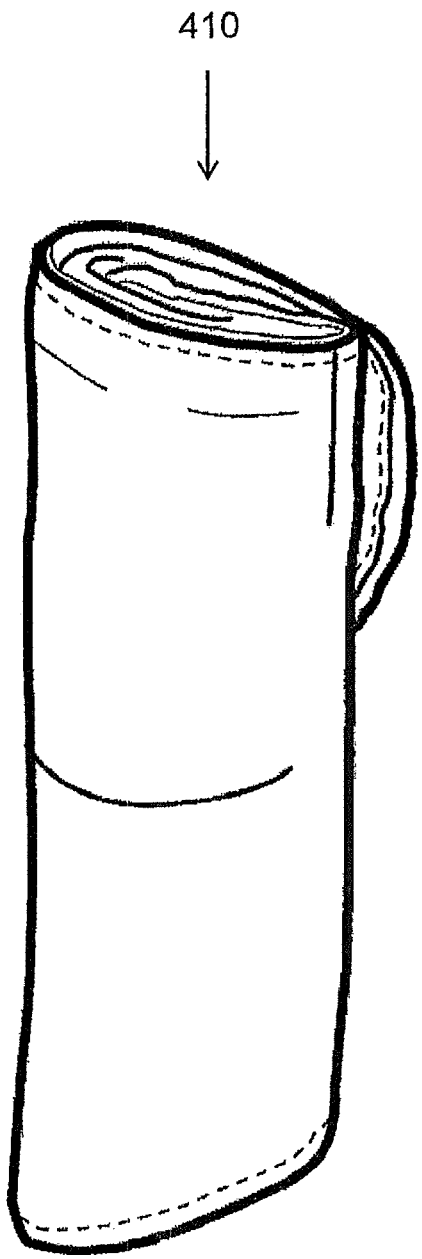
FIG. 15 is a side view of the collapsible chair shown in FIG. 12 in a collapsed or folded and rolled configuration.

Collapsible chair 410 folds easily into the collapsed configuration as shown in FIGS. 14 and 15 by collapsing brace assembly 480 to allow first back support member 450 and second back support member 460 and first seat support member 418 and a second seat support member 420 to come together in unison, and seat membrane 422 and back membrane 468 to collapse and fold. The result is a stadium seat with excellent back support that is easily set-up, collapsed, stored and transported.

Figure 16:
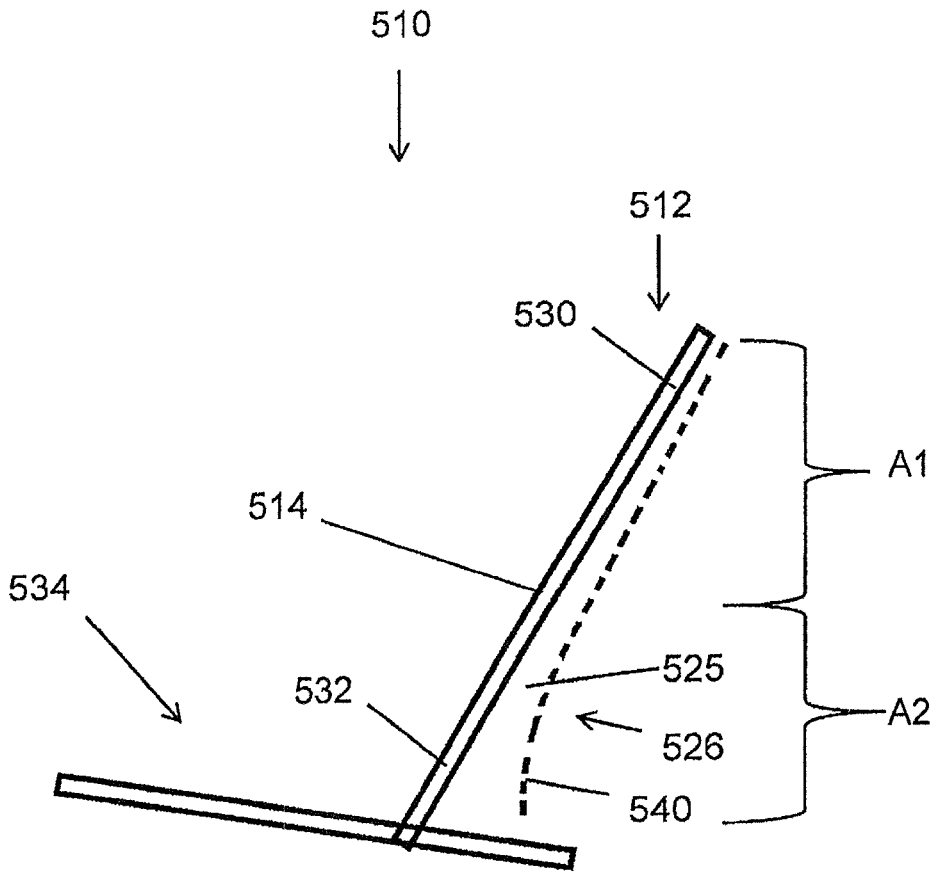
FIG. 16 is a simplified side view of an alternative exemplary collapsible back support and seat for a chair in the deployed position.

In an alternative embodiment shown schematically in FIG. 16, a collapsible chair 510 includes a collapsible back portion 512 having opposing back support members 514 that are straight (not curved) and angled backward from a vertical orientation. A back membrane 525 is coupled to back support members 514 to form a curved back support section 526. More specifically, back membrane 525 is coupled to straight back support members 514 securely at an upper portion 530 (corresponding to an area $A_1$ of collapsible back portion 512) such that upper portion 530 is taut, but progressively more loosely on straight back support members 514 at a lower portion 532 (corresponding to an area $A_2$ of collapsible back portion 512). With collapsible chair 510 in the deployed configuration shown in FIG. 16, and a person sitting on a collapsible seat 534 of collapsible chair 510, back support section 526 is taut in area $A_1$ and progressively looser or less taut in area $A_2$ of collapsible back portion 512. This progressively less taut back membrane 525 sags down toward the vertical as shown by dashed line 540 rather than following a straight line along back support members 514. In this embodiment, back membrane 525 forms a convex curve that matches the natural curve of the human spine. When a user sits on collapsible seat 534 with his or her back against back membrane 525, the user's lower back is properly supported.

Another embodiment of the invention is easily envisioned for a sit-on-top kayak or other solid-seat object. By extending the bottoms of back support members 50 and 60 of FIGS. 5-7 the members can be inserted into receiving holes of a molded tilted seat of a sit-on-top kayak or other solid-seat object. To collapse the chair the back support members 50 and 60 are simply removed from the holes and the collapsible back 30 is rolled up similar to that shown in FIG. 7.

Figure 17:
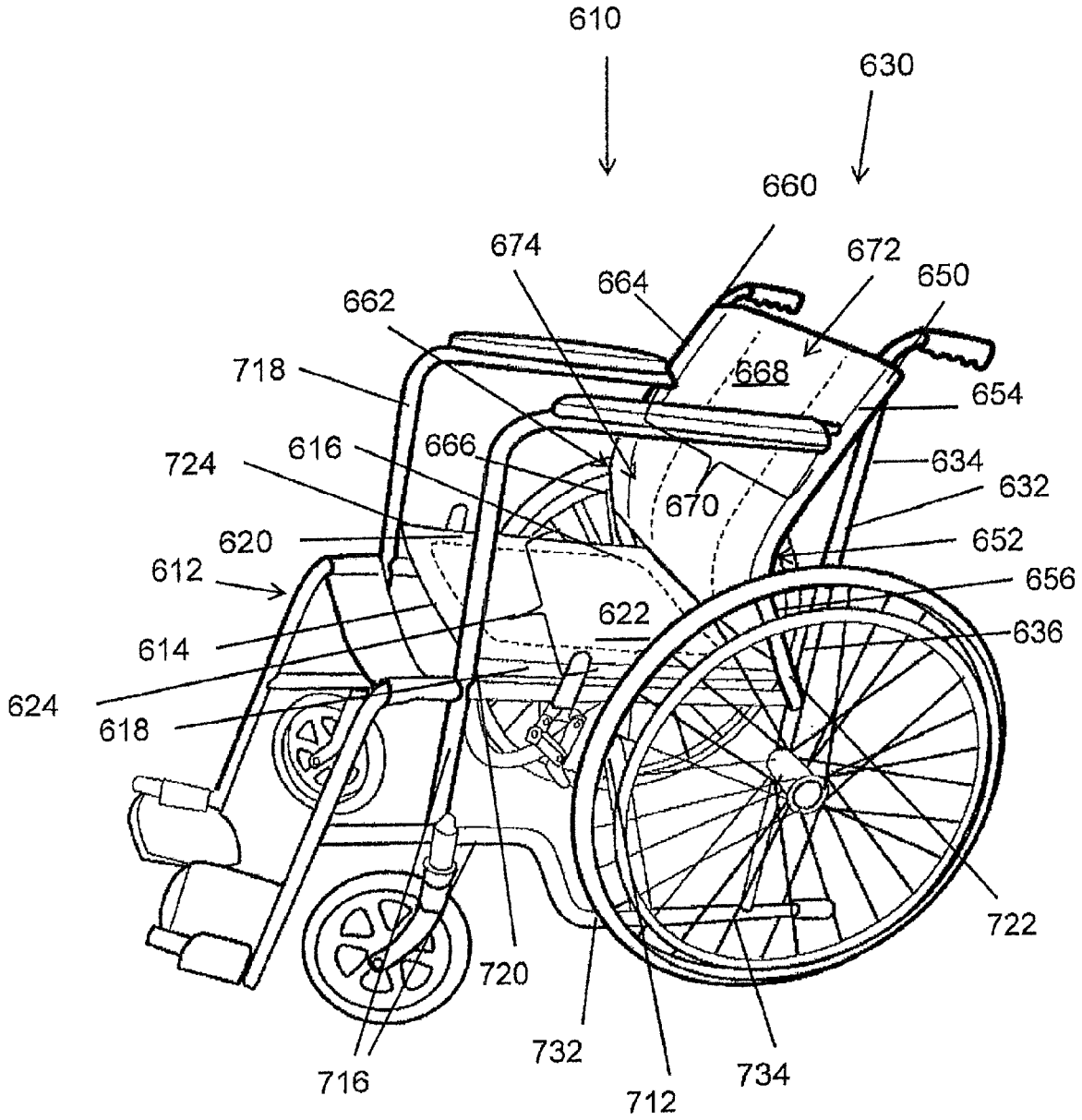
FIG. 17 is a perspective side view of an exemplary folding wheelchair.
Figure 18:
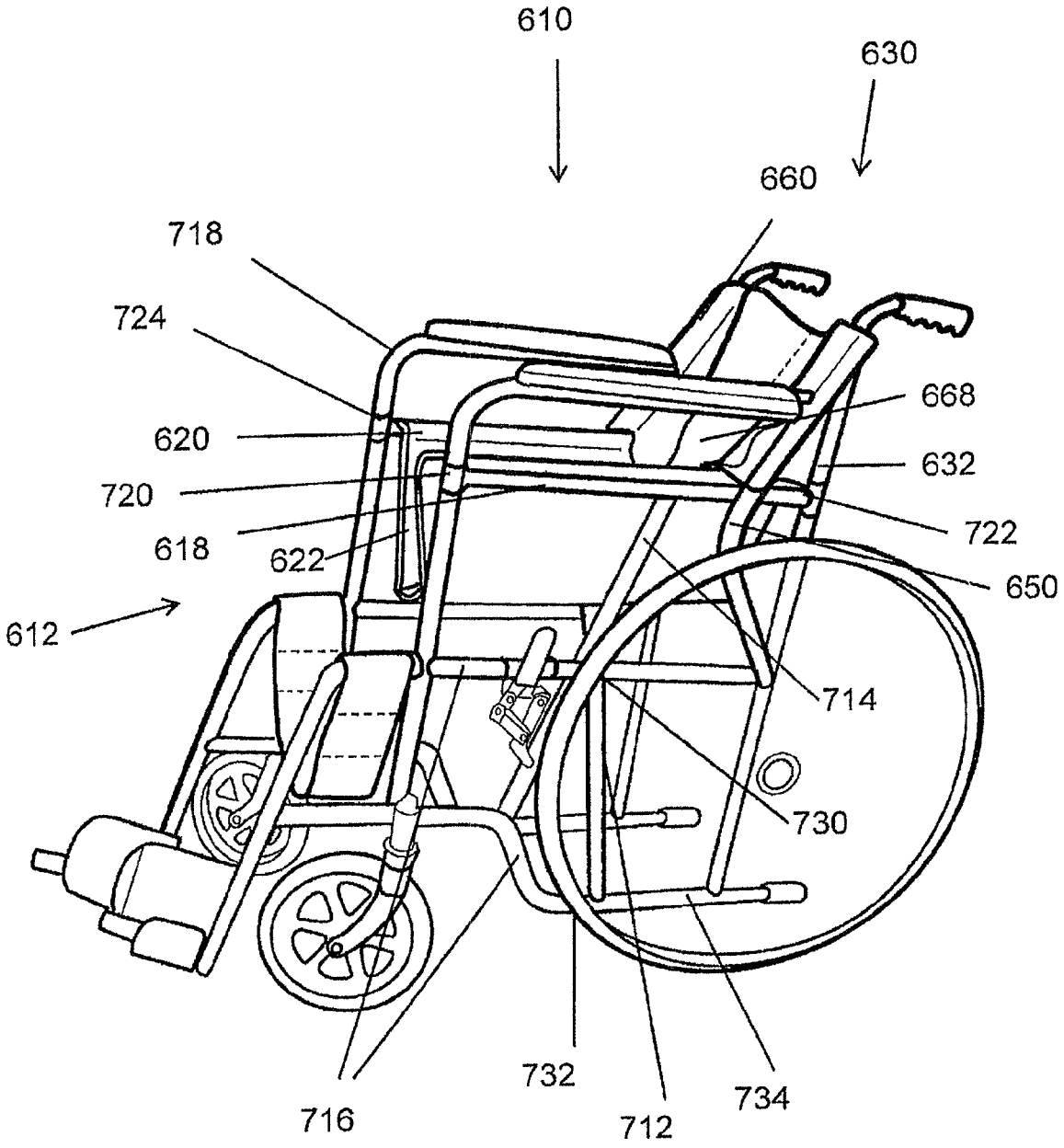
FIG. 18 is a perspective side view of the folding wheelchair shown in FIG. 17, in a partially collapsed position.

FIGS. 17 and 18 show a wheelchair embodiment of the invention 610 with all of the advantageous qualities of back support described previously. In one embodiment a collapsible or foldable wheelchair 610 is movable between a deployed configuration, as shown in FIG. 17, and a collapsed or folded configuration, as shown in FIG. 18. Referring further to FIGS. 17-18, collapsible chair 610 includes a collapsible seat 612 having a front portion 614, a rear portion 616, a first seat support member 618 and a second seat support member 620 spaced apart from first seat support member 618. A seat membrane 622 is coupled to first seat support member 618 and second seat support member 620 and is configured to span a distance 624 defined between first seat support member 618 and second seat support member 620. As shown, for example, in FIG. 17, seat membrane 622 spans a suitable distance 624 with chair 610 in the deployed configuration to allow a user to comfortably sit on seat membrane 622. In certain embodiments, seat membrane 622 is made of a sufficiently durable and suitably flexible, stretch-resistant material, such as a cloth, canvas, leather, or plastic material, to provide a support surface having sufficient strength to support a user.

A collapsible back 630 of collapsible chair 610 is operatively coupled to collapsible seat 612. In one embodiment, collapsible back 630 includes a first back member 632 having a first or upper portion 634 (corresponding to an area $A_1$ of collapsible back 630) that transitions into a second or lower portion 636 (corresponding to an area $A_2$ of collapsible back 630). A second back member (not shown) is spaced apart from first back member 632 and is of the same construction, and also has a first or upper portion that transitions into a second or lower portion.

In one embodiment, collapsible back 630 includes a first back support member 650 that is coupled to upper portion 634 of first back member 632 and has an arcuate portion 652 extending toward front portion 614 of collapsible seat 612. Referring further to FIGS. 17-18, first back support member 650 has a substantially linear first or upper portion 654 that transitions into a second or lower portion 656 forming arcuate portion 652. In an alternative embodiment, upper portion 654 and lower portion 656 collectively form arcuate portion 652. Collapsible back 630 also includes a second back support member 660 that is coupled to upper portion 640 of second back member 638 and has an arcuate portion 662 extending toward front portion 614 of collapsible seat 612. Second back support member 660 has a substantially linear first or upper portion 664 (corresponding to an area $A_1$) that transitions into a second or lower portion 666 (corresponding to an area $A_2$) forming arcuate portion 662. In an alternative embodiment, upper portion 664 and lower portion 666 collectively form arcuate portion 662. Arcuate portions 652 and 662 are configured to substantially match or correspond to a curve of a lumbar region of the user's spine (i.e., the user's lower back). In one embodiment, lower portion 656 of first back support member 650 and lower portion 666 of second back support member 660 are coupled to the lower portion 636 of back member 632 and lower portion 642 of back member 638, respectively. Upper portion 654 of first back support member 650 and upper portion 664 of second back support member 660 are angled away from front portion 614 of collapsible seat 612 when collapsible chair 610 is in the deployed configuration. In a particular embodiment the line extending along upper portion 654 and upper portion 664 is angled at greater than 10 degrees backward from vertical.

A back membrane 668 is coupled to first back support member 650 and second back support member 660 and is configured to span a distance 670 defined between first back support member 650 and second back support member 660 to form a back support section 672. As shown, for example, in FIG. 17, back membrane 668 spans a suitable distance 670 with chair 610 in the deployed configuration to allow a user to comfortably rest his or her back against back membrane 668. In certain embodiments, back membrane 668 is made of a suitable material such as described above in reference to materials suitable for seat membrane 622. In one embodiment, each of arcuate portion 652 and arcuate portion 662 defines an apex 674 that is positioned greater than about four inches above a lowest portion of seat membrane 622 directly beneath apex 674. When collapsible chair 610 is in the deployed configuration, these four plus inches create a space that allows room for the buttocks to be placed in line with or behind apex 674 such that the lumbar region of the spine is comfortably against the back support section 672, and able to retain a healthy curved position supported by section 672.

In this embodiment the seat support members 618 and 620 are connected to crossing support members 712 and 714 and pivotally connected to the chair side frames 716 and 718 at pivot sliding points 720, 722, and 724 (an additional pivot sliding point, a mirror image of 722, is not shown). Side frames 716 and 718 are attached to back members 632 and 638. The crossing support members 712 and 714 are pivotally connected to each other at central pivot point 730 and to the bottom of chair side frames 716 and 718 at pivot points 732, 734, and two additional pivot points not shown that are mirror images of points 732 and 734). To laterally collapse the chair, as with many director's chairs, the seat members 618 and 620 are raised relative to the side frames 716 and 718 of the chair. In this embodiment the seat members 618 and 620 slide up at the seat pivot points thus causing the crossing support members 712 and 714 to pivot at the pivot points. The seat support members 618 and 620 slide up side frames 716 and 718 and bring them together as shown in FIG. 18. The seat membrane 622 easily collapses with the coming together of seat support members 618 and 620. The seat 612 extends below the back support section 672 so that, when a seated person is firmly against the back support section 672 there is ample room for the buttocks to be supported in the rear of the chair under the back support section 672. Because the seat 612 must fold up under the back support section 672 the back support members 650 and 660 are placed to the outside of the seat support members 618 and 620. When the chair is folded the seat support members 618 and 620 move up on the inside of the back support members 650 and 660 pushing against the back membrane 668 and forcing it to slide up back support members 650 and 660. When the chair is opened, seat support members 618 and 620 move down, forcing the side frames 716 and 718 and back support members 650 and 660 apart and allowing back membrane 668 to slide back down back support members 650 and 660 until the chair is opened and the back membrane 668 is taut between members 650 and 660 as shown in FIG. 17. In this embodiment, seat membrane 622 and back membrane 668 are pulled taut as the sides of the chair are forced apart. Advantageously, the tension on back membrane 668 is distributed evenly along first back support member 650 and second back support member 660 to create back support section 672 of uniform taut support. The taut back membrane 668 matches the curve of first and second back support members 650 and 660, particularly at their arcuate portions 652 and 662, and forms a gently curved back support section 672 that matches the natural curve of the human spine to provide positive back support for the seated user that is distributed evenly, firmly, and comfortably along the user's back.

An alternative method for allowing the seat 612 to fold up and rise under the back support section 672 is to place back support members 650 and 660 on the inside of seat members 618 and 620 such that, when the chair is collapsed, the seat members 618 and 620 rise on the outside of the back support members 650 and 660. For this configuration to function holes may be placed in the seat membrane 622 to allow it to slide up and over the curve of the back support members 650 and 660 that are above the seat 612. With back support members 650 and 660 on the inside of seat support members 618 and 620 it is not necessary to have the back membrane 668 slide up support members 650 and 660 if the previously mentioned holes in seat membrane 622 are large enough to accommodate the collapsing back membrane 668.

Another aspect of the embodiment represented in FIGS. 17-18 is the rearward tilting of the seat. As mentioned previously a tilted seat holds a seated person firmly against the back support section 672, discourages the buttocks from slipping forward, and helps prevent the hips and lower back from tilting and curving in the wrong direction resulting in C-sitting as befalls many wheelchair users. In this embodiment the tilting of the seat is accomplished by the orientation of the parallel seat members 618 and 620 being tilted back towards the back support section 672, and the seat membrane suspended between them.

Another aspect of the embodiment for the seat of a collapsible chair is to have the seat curve down in front. As can be seen most easily in FIG. 3 the front of seat members 18 and 20 curve back downward at the front of the seat 14. The seat membrane 22 that spans the distance between them is held taut when the chair is in the deployed position, in the same manner described previously for the back support members 50 and 60, thus conforming to the curved shape of seat support members 18 and 20. The result is the front of the seat 14 falls away from a seated persons legs thus easing sometimes uncomfortable pressure or cutting off circulation in the legs. Additionally, this downward curved area provides a level platform at the top of the curved front of the seat 14 making it far easier for a person to transfer in and out of the chair (particularly important for wheelchair users) or to sit on the front of the seat 14 to lean forward to perform tasks.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A collapsible chair that is movable between a deployed configuration and a collapsed configuration, the collapsible chair comprising:

(i) a collapsible seat comprising:
a front portion;
an opposing rear portion; and
a seat membrane;

(ii) a collapsible back comprising:
a first back support member with a first arcuate portion and a second back support member with a second arcuate portion; and
a back membrane; and (iii) at least two pivotally connected members;

wherein the first arcuate portion and the second arcuate portion extend toward the front portion of the collapsible seat when the chair is in the deployed configuration;

wherein the back membrane is coupled to the first and second back support members, spanning a distance between the first and second support members;

wherein the collapsible seat is constructed and arranged to move together to collapse and fold;

wherein the collapsible back is constructed and arranged to move together to collapse and fold; and wherein each back support member is positioned outside of and in contact with one of the pivotally connected member, keeping the back membrane taut between the arcuate portions when the chair is deployed, to create a curved lumbar support region of the back membrane that supports a lower back of a user.

2. The collapsible chair of claim 1 wherein the collapsible back is operatively coupled to the collapsible seat such that the two can pivot from the deployed configuration to the collapsed configuration, in which the collapsible back and the collapsible seat collapse and fold.

3. The collapsible chair of claim 1 further comprising a first back member and a second back member, the first back member coupled to the first back support member and the second back member coupled to the second back support member.

4. A collapsible chair of claim 3 wherein the pivotally connected members brace the back members, keeping the back membrane taut between the first and second arcuate portions when the chair is in the deployed configuration.

5. The collapsible chair of claim 1 further comprising a plurality of legs, each with a top and a bottom, that support the seat, wherein each of the back support members is coupled to one of the legs at a plurality of locations, one location proximate the top of the legs and another location either between the seat and the bottom of the legs or just above the seat.

6. The collapsible chair of claim 1 wherein the seat membrane is angled slightly backwardly in the deployed configuration.

7. The collapsible chair of claim 1 wherein each arcuate portion defines an apex that is positioned greater than four inches above a lowest portion of the seat membrane.

8. The collapsible chair of claim 1 wherein the back membrane is sized and coupled to the back support members in such a way that when the chair is in the deployed position the back support members pull evenly on the back membrane at a plurality of locations along a length of the back support members, to keep the back membrane generally evenly taut.

9. The collapsible chair of claim 1 wherein the back membrane is inhibited from sliding along a vertical length of the back support members by being connected to them in at least one location.

10. The collapsible chair of claim 1 wherein the back membrane slides up the back support members when the chair is in the collapsed configuration and wherein the back membrane is attached to the collapsible seat, so that when the chair is in the deployed configuration the back membrane is connected in at least one location at a top of the back support members so that the back membrane is prevented from being pulled too low.

11. The collapsible chair of claim 1 wherein one of the at least two pivotally connected members is positioned at the front portion of the chair to support armrests.

12. A collapsible chair that is movable between a deployed configuration and a collapsed configuration, the collapsible chair comprising:

(i) a collapsible seat comprising:
a front portion;
an opposing rear portion; and
a seat membrane;

(ii) a collapsible back comprising:
a first back support member with a first arcuate portion and a second back support member with a second arcuate portion; and
a back membrane;

(iii) a first back member and a second back member; and (iv) at least two pivotally connected members;

wherein the first back support member is coupled to the first back member and the second back support member is coupled to the second back member;

wherein the first arcuate portion and the second arcuate portion extend toward the front portion of the collapsible seat when the chair is in the deployed configuration;

wherein the back membrane is coupled to the first and second back support members, spanning a distance between the first and second support members;

wherein the collapsible seat is constructed and arranged to move together to collapse and fold;

wherein the collapsible back is constructed and arranged to move together to collapse and fold; and wherein the back members are pivotally coupled to, and braced by, the pivotally connected members, therefore keeping the back membrane taut between the arcuate portions when the chair is deployed, to create a curved lumbar support region of the back membrane that supports a lower back of a user.

13. The collapsible chair of claim 12 wherein the collapsible back is operatively coupled to the collapsible seat such that the two can pivot from the deployed configuration to the collapsed configuration, in which the collapsible back and the collapsible seat collapse and fold.

14. The collapsible chair of claim 12 wherein the seat membrane is angled slightly backwardly in the deployed configuration.

15. The collapsible chair of claim 12 wherein each arcuate portion defines an apex that is positioned greater than four inches above a lowest portion of the seat membrane.

16. The collapsible chair of claim 12 wherein the back membrane is sized and coupled to the back support members in such a way that when the chair is in the deployed position the back support members pull evenly on the back membrane at a plurality of locations along a length of the back support members, to keep the back membrane generally evenly taut.

17. The collapsible chair of claim 12 wherein the back membrane is inhibited from sliding along a vertical length of the back support members by being connected to them in at least one location.

18. The collapsible chair of claim 12 wherein the back membrane slides up the back support members when the chair is in the collapsed configuration and wherein the back membrane is attached to the collapsible seat, so that when the chair is in the deployed configuration the back membrane is connected in at least one location at a top of the back support members so that the back membrane is prevented from being pulled too low.

19. The collapsible chair of claim 12 wherein a pivotally connected member is positioned at the front portion of the chair to support armrests.

* * * * *